United States Patent [19]

Satoh et al.

[11] 4,128,142

[45] Dec. 5, 1978

[54] ELEVATOR SPEED CONTROL SYSTEM

[75] Inventors: Tsuyoshi Satoh; Kenzo Tachino, both of Inazawa, Japan

[73] Assignee: Mitsubishi Denki Kabushiki Kaisha, Tokyo, Japan

[21] Appl. No.: 766,508

[22] Filed: Feb. 7, 1977

[30] Foreign Application Priority Data

Feb. 16, 1976 [JP] Japan ..... 51-15596

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,743,055 | 7/1973 | Hoelscher et al. | 187/29 |
| 3,777,855 | 12/1973 | Boyldew et al. | 187/29 |
| 3,785,463 | 1/1974 | Kuhl et al. | 187/29 |
| 3,893,695 | 7/1975 | Rickert | 187/29 |
| 3,941,214 | 3/1976 | Young et al. | 187/29 |

*Primary Examiner*—Robert K. Schaffer
*Assistant Examiner*—W. E. Duncanson, Jr.
*Attorney, Agent, or Firm*—Wenderoth, Lind & Ponack

[57] ABSTRACT

During the acceleration of an elevator car a command acceleration pattern in the form of frequency modulated clock pulses is counted by a first and a second counter. The first counter issues a command speed pattern. The speed pattern is integrated to calculate the distances of movement of the care which is successively stored in a random access memory at addresses determined by the speeds from the second counter, at equal increments of speed. During the deceleration the distances of movement succesively read out from the memory are compared with the residual distances to the stop floor and the second counter counts the results of the comparison down to produce an ideal speed curve. The curve supplied to the memory is also compared with the actual car speed to modify the command acceleration with the result that the actual speed follows up the ideal speed curve.

10 Claims, 17 Drawing Figures

| FIG. 10A | FIG. 10B |
|---|---|

| FIG. 11A |
| --- |
| FIG. 11B |

ELEVATOR SPEED CONTROL SYSTEM

BACKGROUND OF THE INVENTION

This invention relates to improvements in an elevator speed control system.

In elevator systems the elevator car is generally driven through both a mechanical system including an electric motor, a winding mechanism etc. and a rope system and controlled in speed by a speed control system. However, the car does not always travel a distance corresponding to the speed pattern provided by the speed control system due to various external disturbances such as loss occurring in the mechanical system, time delay inherent to the control system, variation in the damping constant of the control system resulting from the change in length of the rope between the winding mechanism and the car which varies in position etc. This has resulted in a disadvantage in conventional speed control systems that the car is difficult to properly accelerate and decelerate attended with a high landing error. On the other hand, the control systems have limitations as to the change in acceleration of the car in view of both a comfortable ride in the car and the traction developed between the winding mechanism and the rope.

Accordingly it is an object of the present invention to provide a new and improved elevator speed control system substantially free from the disadvantages of the prior art practice as described above and decreasing the landing error so that the comfortable ride in the elevator car involved is not deteriorated.

SUMMARY OF THE INVENTION

The present invention provides an elevator speed control system comprising an elevator car, memory means for storing a command speed pattern for the car during the acceleration thereof in the form of a speed-to-position function and means for declerating the car during the deceleration thereof by utilizing the speed-to-position function read out from the memory means.

In a preferred embodiment of the present invention the elevator speed control system may comprise, in combination, an elevator car, a pulse generator means for generating a positional pulse in response to the distance of movement of the elevator car, an actual position register means for accumulating the positional pulses therein to indicate the actual position of the elevator can, a first modulator means for generating a command acceleration pattern, a first counter means for delivering a command speed pattern to the elevator driving system employed during the acceleration of the car through the utilization of the command acceleration pattern, a distance-of-movement memory means for storing the distance of movement of the car resulting from the integration of outputs from the first counter means, a stop position determination means for determining the time point when the elevator car is to be stopped, thereby to deliver a stop determination signal to the first modulator means and provide a signal for the position of a desired stop floor, a second counter means causing the distance-of-movement memory means to store a distance of movement of the car dependent upon a command speed pattern identical to that delivered from the first counter means and at a time point when the command speed pattern reaches a maximum, a subtracter means for calculating the difference between the actual position of the car and the position of the desired stop floor during the deceleration of the car to provide an output representing the residual distance to the desired stop floor, a distance comparator means for comparing a stored distance read out from the distance-of-movement memory means with the residual distance provided by the subtracter means, the distance comparator means being operative to successively count pulses down at and after the time point when the stored distance is greater than the residual distance from the subtracter means as determined by the distance comparator means thereby to form an ideal speed depending on the residual distance corresponding to the output from the second counter means, a speed comparator means for comparing the output from the second counter means with the actual speed of the car to provide a signal for modifying the command acceleration pattern so as to cause the actual speed to approach the ideal speed in accordance with an output from the speed comparator means, and a second modulator means operative during the deceleration to modify the command acceleration pattern in response to an output from the speed comparator means.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
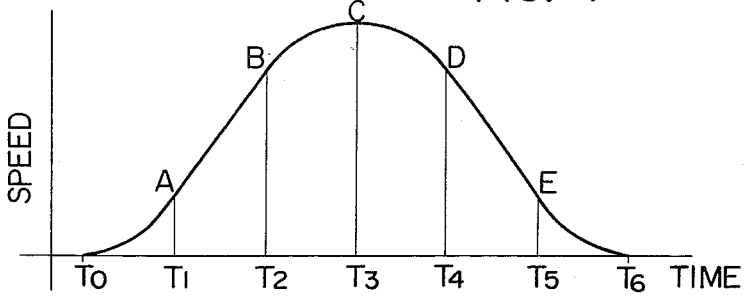
FIG. 1 is a graph illustrating a command speed pattern for an elevator car formed in accordance with the principles of the present invention.

The present invention provides an elevator car speed control system using a command speed pattern including an acceleration section thereof identical in shape to the deceleration section thereof as shown in FIG. 1 wherein the command speed for an associated elevator car is the ordinate against time as the abscissa. According to the principles of the present invention, a command speed pattern $T_0ABC$ for the acceleration of an associated elevator car is generated until a maximum command speed is reached at a point C or at a time point $T_3$ as shown in FIG. 1. Simultaneously, the command speeds are successively stored with respect to corresponding distances of movement of the elevator car, for example, the command speed at point A in conjunction with the distance of movement of the car between time point $T_0$ or the stating time and time point $T_1$ corresponding to the point A. The distance of movement of the car is obtained by intergrating that section of the speed pattern extending from the starting time point to a corresponding time point, that is to say, by the area defined by the section of the speed pattern and the associated portion of the time axis, for example, the curve section $T_0A$ and a portion of the time axis $T_0T_1$. During the deceleration of the elevator car the command speed pattern with the corresponding distances of movement of the car stored during the acceleration is used as an ideal speed curve for the car relating to the residual distance to the desired stop position of the car and a command speed pattern $CDET_6$ for deceleration is generated to cause the actual car speed to follow that ideal speed curve thereby to decelerate the elevator car.

The description will now be made, by way of example, in conjunction with a command speed pattern for the acceleration of an associated elevator car used as an ideal speed curve for the deceleration of the car.

While a command speed pattern for acceleration can be obtained by first generating an acceleration pattern and then integrating it, a command speed pattern for deceleration is formed by comparing the actual speed of the particular car with an ideal speed curve for the car in order that the actual speed may be caused to follow the ideal speed, modifying the acceleration pattern enough to prevent the comfortable ride in the car from deteriorating and integrating the modified acceleration pattern.

Figure 2:
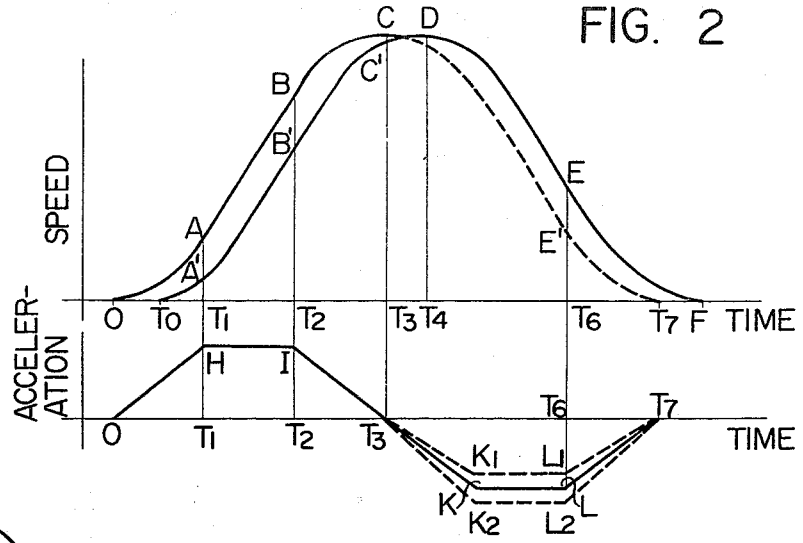
FIG. 2 is a graph illustrating the temporal relationship between a command speed pattern and an acceleration pattern formed in accordance with the principles of the present invention with an elevator car traveling at a speed less than its rated speed.

Referring now to FIG. 2, there are illustrated an acceleration pattern (see the lower portion thereof) and a corresponding command speed pattern (see the upper portion thereof) plotted on the same time axis with the actual speed pattern (see the upper portion thereof). Until the command speed for the associated elevator car reaches its maximum at time point $T_3$, an acceleration pattern $OHIT_3$ for the acceleration of the car is first generated so that a command speed pattern includes a acceleration section symmetric with respect to a deceleration section. The acceleration pattern thus generated is integrated to form a command speed pattern OABC for the acceleration of the car.

More specifically, as shown in FIG. 2, the acceleration linearly increases from its null value at time point 0 to a predetermined value $HT_1$ at time point $T_1$ along a straight line segment OH and then maintains the predetermined value until time point $T_2$ as shown by the horizontal line segment HI after which it linearly decreases to its null value at time point $T_3$ along a straight line segment $IT_3$ equal and opposite in slope to the segment OH. The acceleration pattern $OHIT_3$ formed by these broken lines is integrated to provide the command speed pattern in which, for exsmple, command speeds $AT_1$, $BT_2$ and $CT_3$ appear at time points $T_1$, $T_2$ and $T_3$ respectively.

Simultaneously with the formation of the command speed pattern, the command speeds are successively stored in conjunction with the corresponding distances of movement of the associated elevator caused by that command speed pattern. As above described, the distance of movement to a given time point, for example, time point $T_1$ is obtained by the area bounded by that section of the command speed pattern OA extending from its starting point 0 to the time point $T_1$, the vertical line $AT_1$ and the corresponding portion of the time axis $T_0T_1$.

On the other hand, the actual speed of the car illustrates that the actual speed pattern lags somewhat behind the command speed pattern OABC because the associated control system includes an element or elements exhibiting a time delay or delays. In FIG. 2 the actual speed pattern is shown by the curve $T_0A'B'C'$ and has its maximum D at a time point $T_4$ later than the time point $T_3$.

After the time point 3 when the command speed reaches its maximum, an acceleration pattern for the deceleration of the car or a deceleration pattern is generated which is a mirror image of the acceleration pattern $OHIT_3$ with respect to the time axis and has a first line segment forming an extension of the segment $IT_3$. The deceleration pattern is expressed. by a set of broken lines $T_3K$, KL and $LT_7$. The generation of the deceleration pattern $T_3KLT_7$ results in an ideal speed pattern DEF concerning the residual distance to the desired stop position which is formed by using the command speed pattern stored during the acceleration of the car.

A dotted pattern $CE'T_7$ is a command speed pattern for the car being operated at the actual speed following the ideal speed pattern DEF. In order to generate such a command speed pattern, the acceleration pattern $T_3KLT_7$ for deceleration is modified.

It is noted that the time point $T_6$ when the absolute magnitude of the acceleration is decreased at the point L is when the magnitude of the command speed $E'T_6$ becomes equal to that of the command speed $AT_1$ which appears at the time point $T_1$ when the acceleration reaches its maximum during the acceleration of the elevator car.

Upon modifying the acceleration, it is to be noted that this modification should be prevented from greatly affecting the comfortable ride in the associated car. To this end, a lower limit and an upper limit are established with respect to the original acceleration pattern $T_3KLT_7$ as shown at dotted lines $T_3K_1L_1T_7$ and $T_3K_2L_2T_7$ in FIG. 2, respectively. The acceleration is modified within the region defined by those lower and upper limits and then integrated to form a command speed pattern for deceleration.

Since the actual car speed is delayed with respect to the command speed pattern in a time interval between time points $T_3$ and $T_4$, the car actually moves a distance less than a distance of movement determined by the command speed pattern. This distance of movement corresponds to the area defined by closed line OABC-$T_3$O. Therefore the corresponding residual distance to the desired stop position is larger than that estimated by the command speed pattern. This means that no ideal speed exists with respect to the residual distance between the time points $T_3$ and $T_4$.

Under these circumstances, if the unchanged command speed $CT_3$ forms an ideal speed between the time points $T_3$ and $T_4$ then the acceleration is modified so that the actual car speed approaches the ideal speed $DT_4$ at the time point $T_4$.

Figure 3:
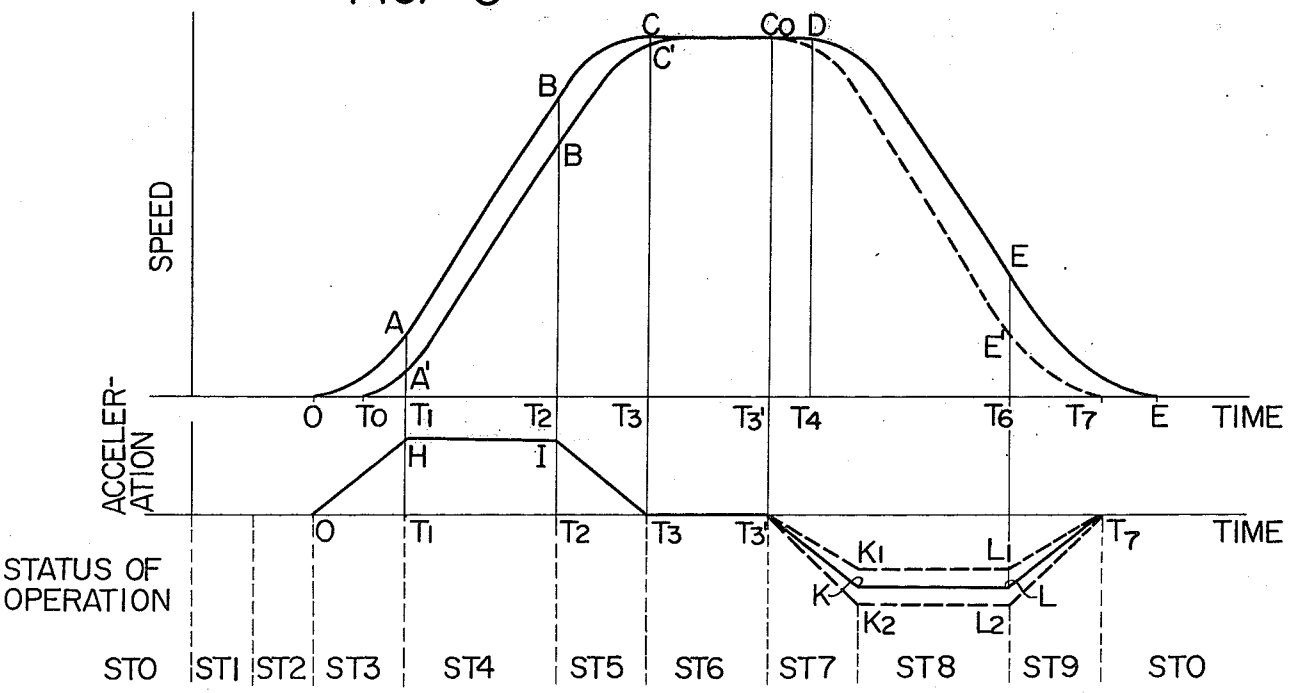
FIG. 3 is a graph similar to FIG. 2 but illustrating an elevator car reaching its rated speed.

While FIG. 2 illustrates the operation of an elevator car at a speed less than its rated speed FIG. 3 illustrates the operation of the car at a speed reaching its rated speed. In FIG. 3 an acceleration pattern $OHIT_3$ is generated in the same manner as above described in conjunction with FIG. 2 until time point $T_3$ when the associated car reaches its rated speed. As in FIG. 2, the acceleration pattern $OHIT_3$ is integrated to form a command speed pattern OABC while simultaneously command speeds are successively stored with respect to corresponding distances of movement of the car.

Under these circumstances, the actual speed pattern of the traveling car is expressed by a pattern $T_0A'B'C'$ with a predetermined time delay relative to the command speed pattern OABC as shown in FIG. 3. After the time point $T_3$ the acceleration is maintained at zero and the command speed is kept at the rated speed until time point $T'_3$ is reached when the car is decelerated in order that the car lands at its desired position or floor. In this case the actual car speed reaches the rated speed with the same time delay as the actual speed pattern $T_0A'B'C'$.

After the time point $T'_3$ when the deceleration is initiated, an acceleration pattern for deceleration that is a mirror image of the acceleration pattern $OHIT_3$ is generated with a first line segment substantially parallel to the last segment $IT_3$. The deceleration pattern is represented by a set of broken lines $T'_3K$, KL and $LT_7$ in FIG. 3. Simultaneously the rated speed $CT_3$ is used as the corresponding ideal speed for the elevator car until the residual distance to the desired stop position is equal to the distance of movement of the car as determined by the command speed pattern for acceleration (this distance corresponds the area bounded by the closed line $OABCT_3O$). After time point $T_4$ the command speed pattern stored during the acceleration is used as the ideal speed pattern for the respective residual distances, the ideal speed pattern being represented by the solid curve $C_0DEF$. Therefore in order to generate the dotted pattern $C_0E'T_7$ so as to cause the actual car speed to follow the ideal speed pattern $C_0DEF$, the acceleration pattern $T'_3KLT_7$ is modified within a region confined by two sets of broken lines $T'_3K_1L_1T_7$ and $T'_3K_2L_2T_7$ and then integrated to form a command speed pattern during the deceleration as in FIG. 2.

Also in this case, the time point when the acceleration is decreased is the point where the magnitude of the command speed pattern for decleration is equal to that of the command speed $AT_1$ at the time point $T_1$ when the acceleration reaches its maximum during the acceleration of the elevator car.

Figure 4:
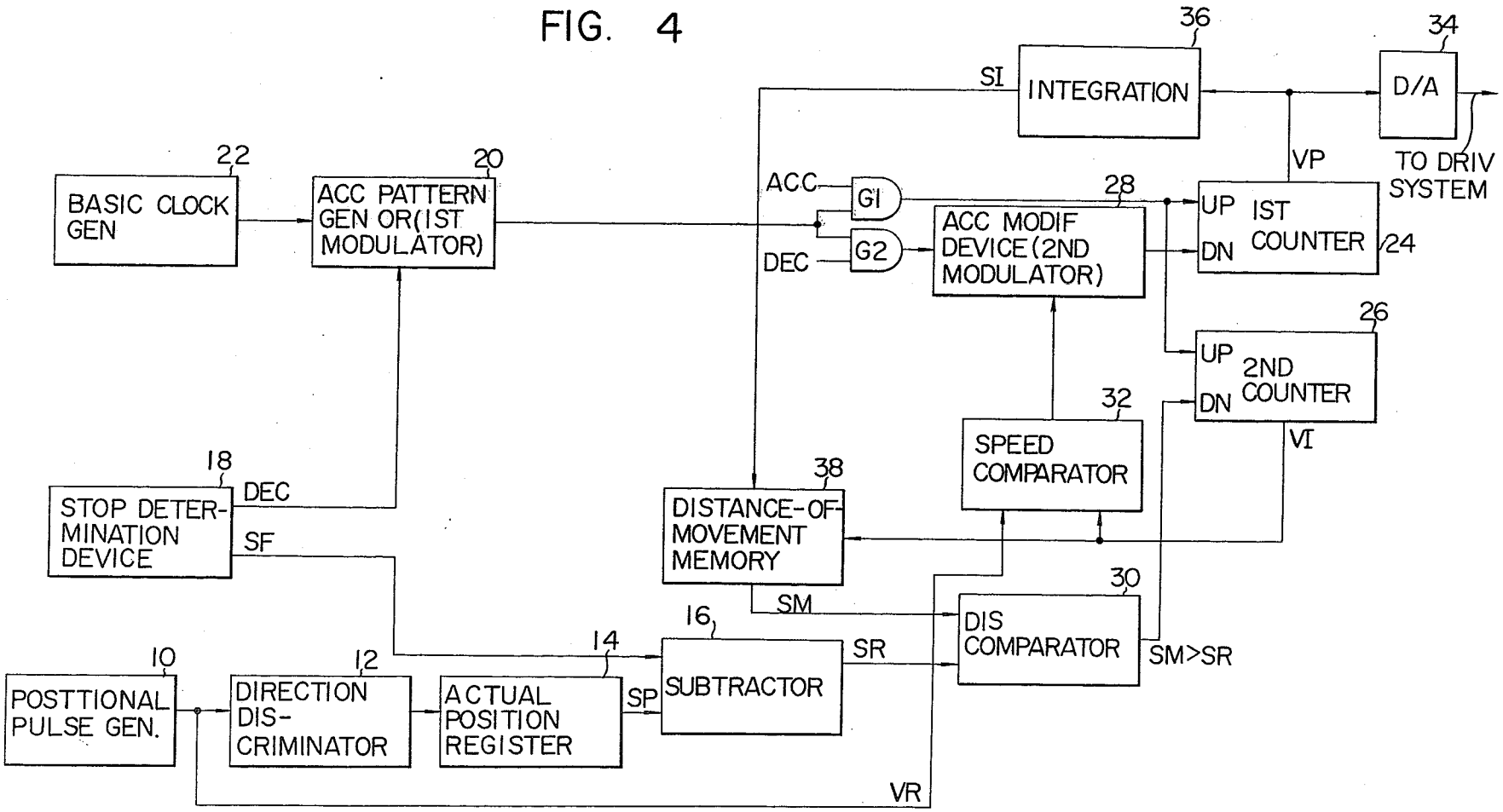
FIG. 4 is a simplified block diagram of an elevator speed control system constructed in accordance with the principles of the present invention.

Referring now to FIG. 4, there is illustrated an elevator car-speed control system constructed in accordance with the principles of the present invention as above described in conjunction with FIGS. 1, 2 and 3. The arrangement illustrated comprises a positional pulse generator 10 for generating positional pulses proportional to the distance of movement of the associated elevator car (not shown) representing the distance by the number of the pulses, a direction discriminator 12 connected to the positional pulse generator 10 to discriminate the direction of movement of the car, and an actual position registor 14 connected to the discriminator 12 to register the positional pulses discriminated in direction. The actual position registor 14 is connected to a subtracter 16 and has a content SP representing the distance between a reference position (which generally refers to the lowermost or uppermost floor of the building served by the associated elevator system) and the actual position of the associated elevator car.

The arrangement further comprises a stop determination device 18 for determining the time point (or the time point $T_2$ shown in FIG. 2) when the acceleration is decreased in order to stop the car at a called floor of the building with the elevator car operated at a speed not reaching its rated speed and the time point (or the time point $T'_3$ as shown in FIG. 3) when the command speed is decreased with the car operated at a speed reaching its rate speed. At the time point thus determined, the stop determination device 18 delivers to the subtracter 16 a stop floor signal SF and delivers to an acceleration pattern generator or first modulator 20 a stop determination signal DEC. The stop floor signal SF indicates the absolute distance of the car from the reference position.

A basic clock generator 22 is connected to the acceleration pattern generator 20 and responsive to a starting signal for the associated elevator car to generate a series of clock pulses as will be described hereinafter. The clock pulses from the generator 20 are applied to the first modulator 20 where they are frequency modulated into a trapezoid as shown at $OHIT_3$ in FIG. 2. The frequency modulated clock pulses from the first modulator 20 are supplied to the UP inputs of first and second reversible counter devices 24 and 26 respectively through gate means $G_1$ receiving acceleration data to be counted up. The first modulator 20 is also shown as being connected to an acceleration modifier or second modulator 28 through another gate means $G_2$ receiving deceleration data. The second modulator 28 is connected to the "DOWN" input of the first counter device 24 while a distance comparator 30 connected to the subtracter 16 is connected to the "DOWN" input of the second counter 26.

An output from each counter device 24 or 26 forms the command speed pattern OABC as shown in FIG. 2. The output VP from the first counter device 24 is applied to a digital-to-analog converter 34 which, in turn, delivers a command speed signal in analog form to a mating driving system (not shown) for the associated elevator car. The output VP from the first counter device 24 is also applied to an integrator 36 to be integrated to form a distance-of-movement signal SI dependent upon the command speed pattern. The signal SI form the integrator 36 is supplied to a distance-of-movement memory 38 having applied thereto the command speed signal VI from the second counter device 26 as an address signal. Thus each time the second counter device 26 counts one pulse up, the distance-of-movement signal SI is stored in the memory 38 and indeed at an address determined by the output VI from the second counter device 26. The memory 38 is formed of a randum access memory able to perform both the writing-in and reading-out operations.

After the time point $T_3$ (FIG. 2) the first modulator 20 frequency modulates the clock pulses from the basic clock generator 22 into an inverted trapezoid $T_3KLT_7$ as shown in FIG. 2 as during the deceleration but under the control of the stop determination signal DEC from the stop determination device 18. The frequency modulated clock pulses from the acceleration pattern generator or first modulator 20 are supplied to the DOWN input to the first counter device 24 through the gate means $G_2$ receiving deceleration data and the acceleration modifier device or second modulator 28 to be counted down.

On the other hand, the command speed reaches its maximum magnitude $CT_3$ to close the gate means $G_1$ and thereby suspends the counting operation performed by the second counter device 26. This results in the distance-of-movement memory 38 storing and holding a distance of movement of the car dependent upon the command speed pattern at the point C (see FIG. 2) when the command speed has finally reached its maximum. Thus the output from the memory 38 is maintained at the now stored distance of movement. This distance of movement corresponds to the area bounded by the closed line $OABCT_3O$ as shown in FIG. 2.

Upon initiating the deceleration, the distance of movement at the point C where the command speed has reached its maximum is first read out of the memory 38 by using the address represented by the corresponding output from the second counter device 26. The distance of movement thus read out is designated SM. Also the subtracter 16 calculates the difference between the actual car position signal SP that is the content of the actual position register 14 and the stop floor signal SF from the stop determination device 18 to produce a residual distance signal SR indicating the residual distance to the desired floor where the car is to land.

Both signals SM and SR are applied to the distance comparator 30 where they are compared with each other. When the signal SM is greater than the signal SR the distance comparator 30 applies its output to the DOWN input of the second counter device 26 whereby the latter counts one pulse down. Since the distance-of-movement memory 38 is supplied with the output from the second counter device 26 as an address signal, the memory 38 provides a distance of movement signal SM concerning that command speed one unit less than the just preceding command speed.

In this way the distance-of-movement signals SM successively read out of the memory 38 are successively compared with the corresponding residual distance signal SR from the subtracter 16 while the second counter device 26 successively counts down as long as the signal SM is greater than the signal SR. This results in the second counter device 26 generating an ideal speed dependent upon the residual distance.

This ideal speed signal VI from the second counter device 26 is also supplied to a speed comparator 32 along with the actual speed signal VR from the positional pulse generator 10.

It is now assumed that the car moves a distance $S_o$ for each positional pulse and a pulse repetition frequency of and $f_I$ designates the pulse repetition frequency of an ideal speed $V_I$ for the car calculated in terms of the number of the positional pulses. Under the assumed conditions the car has an actual speed $V_R$, having an associated pulse repetition frequency of $f_R$, and an ideal speed $V_I$ expressed respectively by $$V_R = S_o f_R \quad (1)$$

and $$V_I = S_o f_I \quad (2)$$

Also the positional pulses have a pulse repetition period $\lambda_R$ expressed by $$\lambda_R = 1/f_R \quad (3)$$

It is also assumed that the ideal velocity has a maximum magnitude $V_{Imax}$ and that, A clock pulses have a pulse repetition frequency $f_o$ and B clock pulses have a pulse repetition frequency $f_I'$ proportional to the ideal velocity $V_I$. Then $$f_I' = f_o V_I / V_{Imax} \quad (4)$$

is obtained. The B clock pulses have a pulsewidth $\lambda_I'$ expressed by $$\lambda_I' = 1/f_I' = V_{Imax}/f_o V_I \quad (5)$$

Substituting the equation (2) into the equation (5) yields $$\lambda_I' = V_{Imax}/f_o S_o f_I \quad (6)$$

The equations (3) and (6) give $$\lambda_R/\lambda_I' = f_o S_o f_I / V_{Imax} f_R \quad (7)$$

If the car has the actual speed equal to the ideal speed, then the equations (1) and (2) give $$f_R = f_I$$

Therefore the equation (7) yields $$\lambda_R/\lambda_I' = f_o S_o / V_{Imax}$$

which is a constant $K_o$. This is because $f_o$, $S_o$ and $V_{Imax}$ are known.

From the foregoing it will readily be understood that whether the actual speed of the car is higher or lower than the ideal speed thereof can be decided by counting the B clock pulses with the pulse repetition frequency $f_I'$ within each pulse repetition period $\lambda_R$ of the positional pulses and determining if the resulting count exceeds the constant $K_o$.

Figure 5:
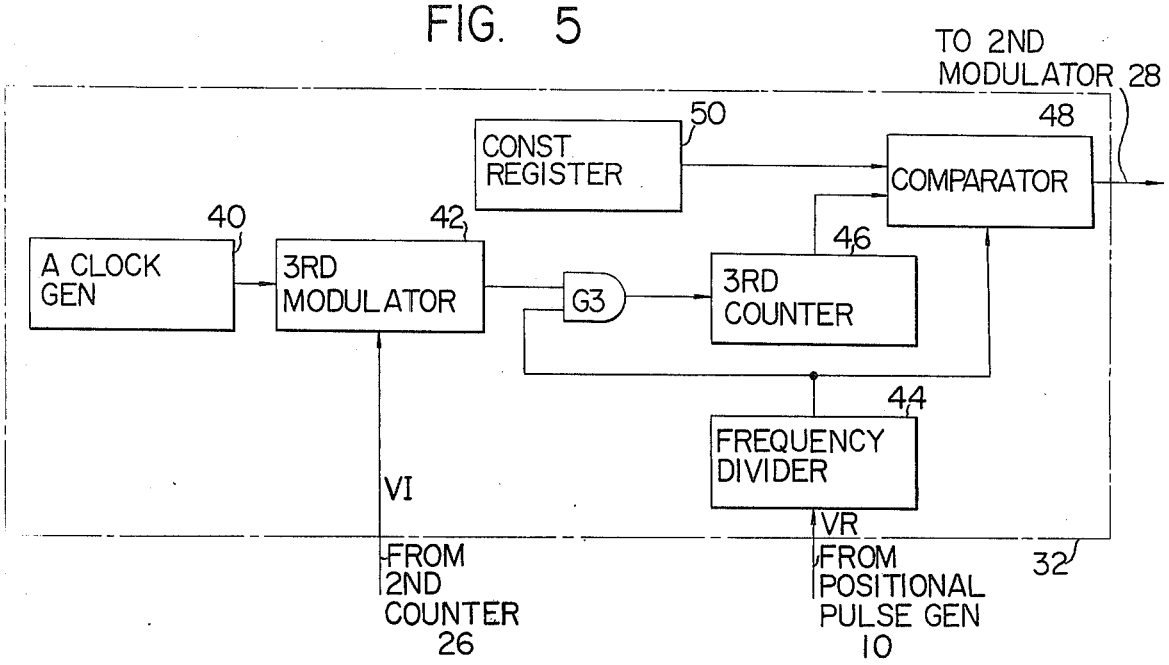
FIG. 5 is a block diagram of the speed comparator circuit shown in FIG. 4.

This decision can be effected by the speed comparator 32 having a circuit configuration as shown in block form in FIG. 5.

As shown in FIG. 5, the speed comparator 32 includes an A clock generator 40 for generating a train of A clock pulses having the pulse repetition frequency $f_o$. The train of A clock pulses from the generator 40 is supplied to a third modulator 42 also supplied with the ideal speed signal $V_I$ from the second counter device 26. The modulator 42 produces a train of B clock pulses having a pulse repetition frequency $f_I'$ proportional to the ideal speed $V_I$ generated by the second counter device 26.

On the other hand, the positional pulse generator 10 successively applies the positional pulses representing the actual car speed $V_R$ to a frequency divider 44 where the pulse repetition frequency of the positional pulses is halved to produce what is called herein halved positional pulses. The halved positional pulses are successively applied to a gate means $G_3$ to open it for the pulse repetition period $\lambda_R$ of the positional pulses to permit the B clock pulses to pass to a third counter 46 through the thus opened gate means $G_3$. The count of the third counter 46 is supplied to a comparator 48 which is also supplied with a constant $K_o$ preliminarily registered on constant register 50. The comparator 48 compares the count from the third counter 46 with the constant $K_o$ to deliver to the second modulator 28 the result of this comparison each time the halved positional pulses rise. Thus whether or not the actual speed is higher than the ideal speed is decided each time two positional pulses from the positional pulse generator 10 reach the comparator 48.

As apparent from the equation (7), $$\lambda_R/\lambda_I' = f_oS_oV_I/V_{Imax}V_R$$

is given. Therefore, it is assumed that a ratio of the ideal speed $V_I$ to the actual speed $V_R$ has a lower limit of $\alpha$ less than unity and an upper limit of $\beta$ greater than unity. That is $$V_I/V_R = \alpha < 1 \text{ and } V_I/V_R = \beta > 1$$

are obtained Then, instead of the single constant $K_o$, a pair of constants $K_s$ and $K_L$ are selected to fulfil the following expressions:

$$K_S = (f_oS_o/V_{Imax})\alpha = \alpha K_o$$

and $$K_L = (f_oS_o/V_{Imax})\beta = \beta K_o \quad (13)$$

Figure 6:
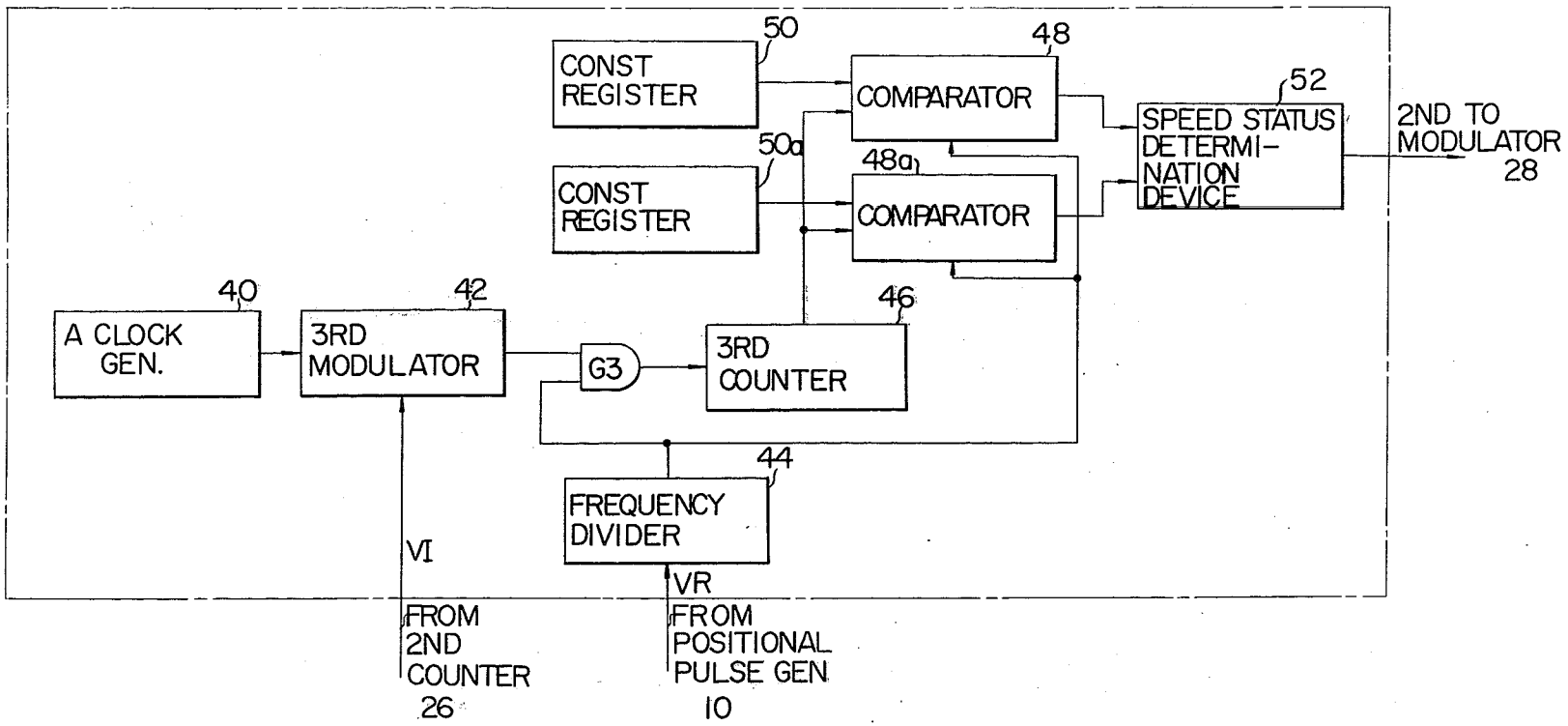
FIG. 6 is a diagram similar to FIG. 5 but illustrating a modification of the arrangement shown in FIG. 5.

Under these circumstances, the arrangement of FIG. 5 may be modified to that shown in FIG. 6 wherein like reference numerals designate components identical to or corresponding to those illustrated in FIG. 5. The arrangement illustrated includes a pair of comparators 48 and **48*a* having one input connected to the third counter 46 and other inputs connected to individual constant registers 50 and 50*a* storing therein the constants $K_s$ and $K_L$ respectively. Both comparators 48 and 48*a* have outputs connected to a speed status-determination device 52 subsequently connected to the second modulator 28. The comparators 48 and 48*a* are identical in construction to each other and may be similar to the comparator 48 shown in FIG. 5. In other respects the arrangement is identical to that shown in FIG. 5**.

In the arrangement of FIG. 6 it will readily be understood that the speed status-determination device 52 determines the speed status of the actual speed relative to its corresponding ideal speed. That is, the device 52 determines which of the relationships $V_R > V_I/\alpha$, $V_I/\alpha \geqq V_R \geqq V_I/\beta$ and $V_I/\beta > V_R$ is met by the actual speed and provides an output corresponding to the determined relationship between the ideal and actual speeds.

Referring back to FIG. 4, assume that the speed comparator 32 determines that the ideal speed is greater than actual speed or $V_I > V_R$ as a result of the comparison of the ideal speed with the actual speed. Under this assumed condition the acceleration modifier or the second modulator 28 is operative to modulate the acceleration clock pulses from the acceleration pattern generator or the first modulator 20 in a direction to decrease the frequency. On the contrary, if the relationship $V_I < V_R$ is determined by the speed comparator 32, then the second modulator 28 causes modulation in a direction to increase the frequency. As a result, the acceleration pattern is modified so that the actual speed approaches an ideal speed dependent upon the particular residual distance. More specifically, during the deceleration the acceleration clock pulses modified by the second modulator 28 are applied to the DOWN input of the first counter 24 to decrease the count thereon to provide, as its output, a command speed such that the actual speed follows the ideal speed pattern.

Since any abrupt change in acceleration leads to the great deterioration in comfort of the ride in the associated elevator car, the second modulator 28 is designed and constructed such that is performs the modulating operation within an upper and a lower limit as to its modulation rate. Also a tolerance zone may be imparted about the ideal speed applied to the speed comparator 32 as shown in FIG. 6 while the second modulator 28 is provided with a blind zone to disable the modification of the acceleration provided that the actual speed enters the tolerance zone about the ideal speed.

Figure 7:
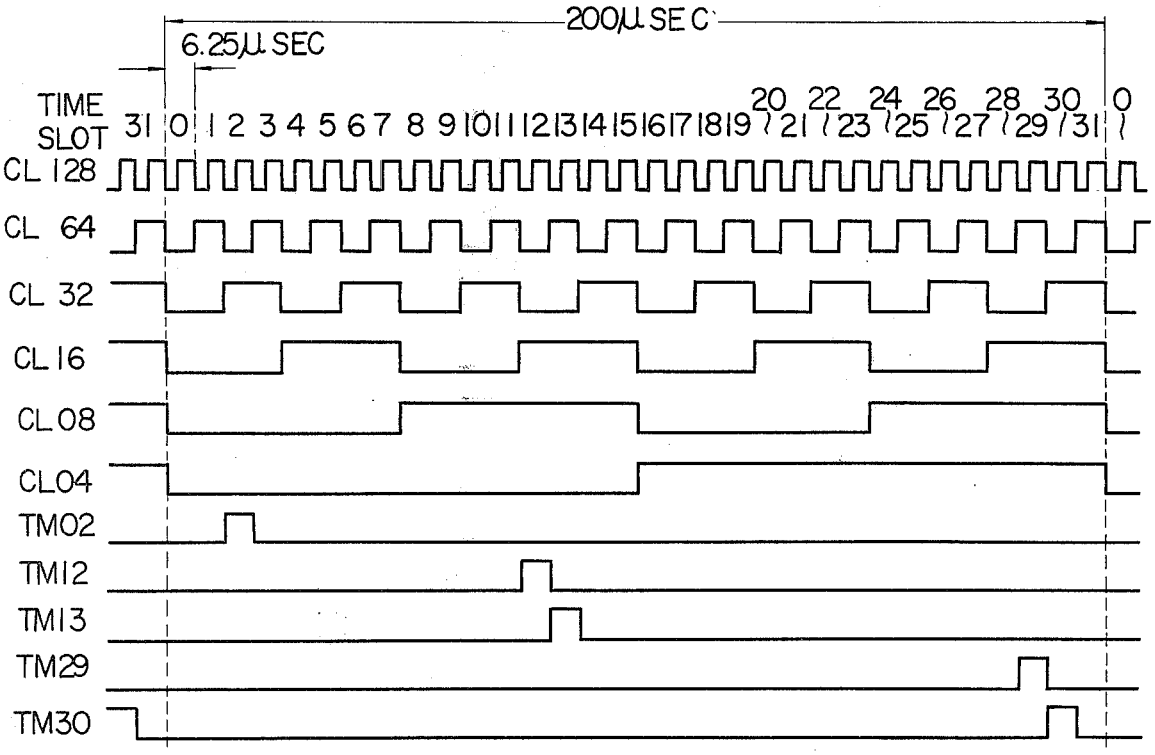
FIG. 7 is a time chart of the basic operation clock pulses, auxiliary clock pulses and timing pulses used with a preferred embodiment of the present invention.

Referring now to FIG. 7, there are illustrated a train of basic operation clock pulses used with a preferred embodiment of the present invention as will be described in detail hereinafter and various clock pulses and timing signals developed therein for one complete period of the fundamental operation thereof. As shown in FIG. 7, the fundamental operating period includes thirty-two (32) basic operation clock pulses designated by CL128 having a pulse repetition period of 6.25 microseconds. Thus the fundamental operating period is of 200 microseconds. Also trains of clock pulses CL64, CL32, CL16, CL08 and CL04 shown in FIG. 7 are formed by dividing the frequency of the basic operation clock pulses CL128 by two, four, eight, sixteen and thirty-two respectively. For example, the clock pulses CL04 have a pulse repetition period equal to the fundamental operating period.

FIG. 7 further shows timing signals TM02, TMO12, TM13, TM29 and TM30 at specified temporal positions within the fundamental operating period respectively. In order to identify the temporal positions of the timing signals, the successive pulse periods of 6.25 microseconds of the basic operation clock pulses CL128 within the fundamental operating period are also called "time slots" 0, 1, 2, . . . 31 and the temporal position of each timing signal is indicated by the number of that time slot in which each timing signal has a value of binary ONE. For example, the timing signal TM13 has its temporal position identified by the time slot 13. Those timing signals are formed of the clock pulses CL64 through CL04 followings the Boolean expressions.

$$TM02 = \overline{CL64}\cdot CL32\cdot\overline{CL16}\cdot\overline{CL08}\cdot\overline{CL04}$$

$$TM12 = \overline{CL64}\cdot\overline{CL32}\cdot CL16\cdot CL08\cdot\overline{CL04}$$

$$TM13 = CL64\cdot\overline{CL32}\cdot CL16\cdot CL08\cdot\overline{CL04}$$

$$TM29 = CL64\cdot\overline{CL32}\cdot CL16\cdot CL08\cdot CL04$$

and $$TM30 = \overline{CL64}\cdot CL32\cdot CL16\cdot CL08\cdot CL04$$

One embodiment of the present invention will now be described in conjunction with FIG. 8 et seq wherein there are illustrated circuit configurations of the blocks shown in FIGS. 4, 5 and 6.

Figure 8:
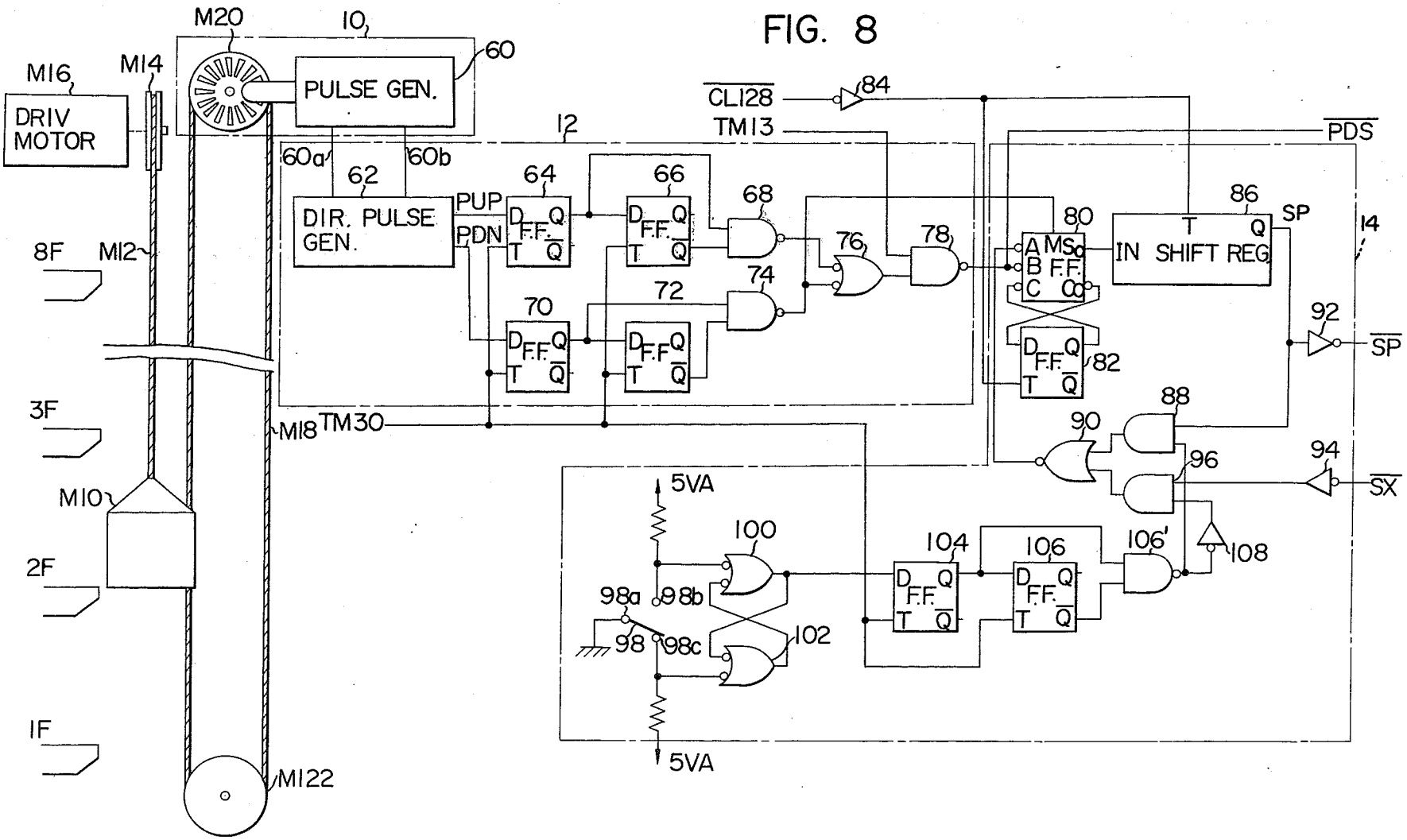
FIG. 8 is a circuit diagram of an elevator position detection mechanism constructed in accordance with the present invention and a schematic view of an elevator system operatively associated with the position detection mechanism.

FIG. 8 shows a simplified model for a mechanism for sensing the position of the associated elevator car and a circuit configuration thereof. The arrangement illustrated comprises a modeled elevator system including an elevator car M10 supported by a winding rope M12 operatively connected to a traction sheave M14 disposed above the upper end of the travel of the car M10 in an associated hatchway (not shown) and an electric reversible motor M16 operatively connected to the traction sheave M14 to drive the latter to wind and unwind the winding rope M12 on and off the seave M14. The motor M16 may be a DC motor such as used in the Ward-Leonard drive system. The elevator car M10 is also connected at the upper and lower ends to a governor rope M18 in the form of a loop spanned between a governor sheave M20 located above the upper end of the hatchway and a pulley M22 located at the bottom of the hatchway. The governor rope M18 always moves at the same speed as the car M10 and also connects to an emergency stop device (not shown) disposed within the car M10. If the emergency stop device is actuated then the governor rope M18 transmits the signal to the car M10 to stop the latter.

The elevator system illustrated is adapted to serve eight floors 1F, 2F, 3F, ----- 8F of a building (not shown).

The governor sheave M20 with a pulse generator 60 operatively connected thereto shown in FIG. 8 forms a positional pulse generator 10. The pulse generator 60 responds to the rotational movement of the governor sheave M20 to generate two sets of pulses 60*a* and 60*b* having a quadrature phase relationship.

The two sets of the pulses 60*a* and 60*b* are applied to a directional pulse generator 54 included in the direction discriminator 12. The directional pulse generator 62 is operative to discriminate the direction of travel of the car M10 so that during the upward travel of the car M10, UP pulses PUP are generated in synchronization with each of the pulses 60*a* or 60*b* from the positional pulse generator 10 while during the downward travel of the car a DOWN pulses PDN are generated in synchronization with each of the pulses 60*b* or 60*a*. Each "UP" pulse PUP is applied to a series combination of two D FLIP-FLOP's 64, and 66 and a NAND gate 68 interconnected in tandem. More specifically, the FLIP-FLOP 64 has its input D receiving the UP pulses PUP and its output Q connected to the FLIP-FLOP 66 at the input D. Then the FLIP-FLOP 66 is connected at the output $\overline{Q}$ to one input to the NAND gate 68 including which has its other input connected to the output Q of the FLIP-FLOP 64. Both FLIP-FLOP's have clock inputs T supplied with the timing signal TM30. The series combination 64-66-68 is operative to convert each UP pulse PUP to a pulse having a pulsewidth equal to the pulse repetition period of the timing signal TM30.

Similarly each DOWN pulse PDN is applied to a series combination of D FLIP-FLOP's 70 and 72 and a NAND gate 74 identical in construction and connection to the series combination 64-66-68 to be converted to a pulse having a pulsewidth equal to the pulse repetition period of the timing signal TM30.

The pulse from the NAND gate 68 passes through an OR gate 76 to a NAND gate 78 to open the latter to permit the timing signal TM13 to pass through the thus opened NAND gate 78. This also occurs in the case of the pulse received from the NAND gate 74.

Thus it is seen that each of the UP and DOWN pulses PUP and PDN respectively is converted to a single pulse synchronized with the timing pulse TM13.

This pulse is then supplied to the actual position register 14. As shown in FIG. 8, the actual position register 14 includes a binary full adder/subtracter 80 having an addition input A, an addition/subtraction input B, a carry input C, an addition/subtraction selection input M, a carry out $C_o$ and an operation output $S_o$. The carry output $C_o$ and the carry input C are respectively connected to input D and output Q of D FLIP-FLOP 82. The full adder/subtracter 80 is adapted to perform subtraction when the addition/subtraction subtraction selection input M receives a value of binary ZERO while it performs the addition when the input M receives a value of binary ONE. To this end, the output of the NAND gate 74 is also connected to the addition/subtraction selection input M. Also the basic operation clock pulses CL128 from an inverter 84 are successively supplied to the clock input T of the FLIP-FLOP 82 thereby to return the carry output $C_o$ from the adder/subtracter 80 back to the carry input C through the FLIP-FLOP 82 with a time delay corresponding to the pulse repetition period of the basic operation clock pulses CL128.

The operation output $S_o$ of the adder/subtracter 80 is connected to the input IN of shift register 86. In the example illustrated the shift register 86 includes thirty-two serial bit positions and may be in the form of four 8-bit shift registers such as marketed under TTL-IC SN7491A by Texas Instruments Inc. serially interconnected. The shift register 86 has an output Q connected to the addition input A of the adder/subtracter 80 through an AND gate 88 and a NOR gate 90.

Thus it will be appreciated that the components 80, 82 and 86 form a 32-bit serial adder/subtracter device.

Assuming that the elevator car initially travels upwardly, the UP pulses PUP are successively generated from the directional pulse generator 62 and applied to the series combination 64-66-68. As above described, pulses synchronized with the timing pulses TM13 one for each UP pulse are successively supplied to the adder/subtracter 80 at the addition/subtraction input B. At that time, the adder/subtracter 80 performs the additional operation because the addition/subtraction selection input M has a value of binary ONE supplied by the NAND gate 74. Accordingly the shift register 86 stores positional pulses in the form of a binary number each representing one unit distance of travel of the car corresponding to each UP pulse PUP, starting with a time slot 13 of the fundamental operation period (see FIG. 7) and in the direction of increasing the time slot-numbers.

Assuming now that the content of the shift register 86 is reset when the car lands at a reference floor, for example, the lowermost floor, the shift register 86 provides at the output Q a binary 32-bit actual position signal SP representing the distance between the car and the reference floor, the signal SP being expressed in the form of 32 serial bits with the least significant bit put in the time slot 13. The signal SP is applied to an inverter 92.

It is to be noted that in FIG. 8 et seq and in the description therefore the reference characters designating each signal represents that signal whose significant logic level has a value of binary ONE when the upper bar is omitted and whose significant logic level has a value of binary ZERO when the upper bar is included. For example, the signal SP has a value of binary ONE and the signal $\overline{SP}$ has a value of binary ZERO. However, in FIGS. 4, 5 and 6 every signal is designated by corresponding reference characters without an upper bar thereof and their binary values are discarded.

When the car travels downwardly, the DOWN pulses PDN are successively generated from the directional pulse generator 62 and applied to the series combination 70-72-74. Then pulses synchronized with the timing pulses TM13 are successively applied to the addition/subtraction input B of the adder/subtracter 80 as described above. At that time the addition/subtraction selection input M of the adder/subtracter 80 receives a binary ZERO due to the output from the NAND gate 74 and therefore adder/subtracter 80 performs subtraction. That is, each time a single DOWN pulse PDN is developed, the number represented by the positional pulses stored in the shift register 86 is subtracted by one unit. That is, the actual position stored in the shift register 86 is successively decreased.

As shown in FIG. 8, an inverter 94 is connected to one input to an AND gate 96 subsequently connected to the other input to the NOR gate 90 while a predetermined floor position signal $\overline{SX}$ is applied to the inverter 94. The floor position signal $\overline{SX}$ represents the distance between an associated floor and the reference floor in terms of the number of unit positional pulses and in the form of a 32-bit binary number with the least significant bit in the time slot 13. The floor positional signal $\overline{SX}$ is formed by a circuit for setting the position of a corresponding floor although this a circuit is not illustrated.

In order to set the initial position of the car, the corresponding floor position signal $\overline{XS}$ representing the actual position of the car is stored in the shift resister 86. To this end, a transfer switch 98 is provided including a movable arm 98*a* connected to ground and a pair of stationary contacts 98*b* and 98*c* connected to an electric source 5VA through respective resistors. The movable arm 98*a* normally engages the contact 98*c*. Contact 98*b* is connected to one input of NAND gate 100 and contact 98*c* is connected to one input of NAND gate 102. These NAND gates form a FLIP-FLOP with the second input of each gate connected to output of the other gate. The output of the NAND gate 100 is connected to the second input of the AND gate 88 through a series combination of D FLIP-FLOP's 104 and 106 and a NAND gate 106 identical in both construction and connection to the series combination of the D FLIP-FLOP's 64 and 66 and the NAND gate 68 as described above with the timing signal TM30 applied to the clock inputs T of both FLIP-FLOP's. The gate 106 also has its output connected to the second input of the AND gate 96 through an inverter 108.

With the movable arm 98*a* engaging the contact 98*c* of the switch 98 as shown in FIG. 8, the gate 100 provides an outut of binary ZERO. However, the engagement of the movable arm 98*a* with the contact 98*b* causes the gate 100 to provide an output of binary ONE. Then the FLIP-FLOP's 104 and 106 and the NAND gate 106 are operated to cause the NAND gate 106 to produce a pulse having a pulsewidth corresponding to the pulse repetition period of the timing signal TM30 upon the rise of the output from the NAND gate 100. This pulse is applied to AND gate 88 to close it for one complete, fundamental operation period while at the same time being applied to AND gate 96 through the inverter 108 to open the gate 96 for the same period. Thus the floor position signal $\overline{SX}$ is permitted to pass through the gate 96 to be applied to the addition input A to the adder/subtracter 80. As a result, the actual position signal SP stored at that time in the shift register 86 is entirely replaced by the new floor position signal $\overline{SX}$.

In the embodiment illustrated the process of generating the command speed pattern is divided into ten operational states through 9 and status-of-operation signals designated by ST0, ST1, ST2, ..... ST8 and ST9 indicating the state of operation respectively are generated by a status-of-operation signal generator circuit as shown in FIG. 9.

Figure 9:
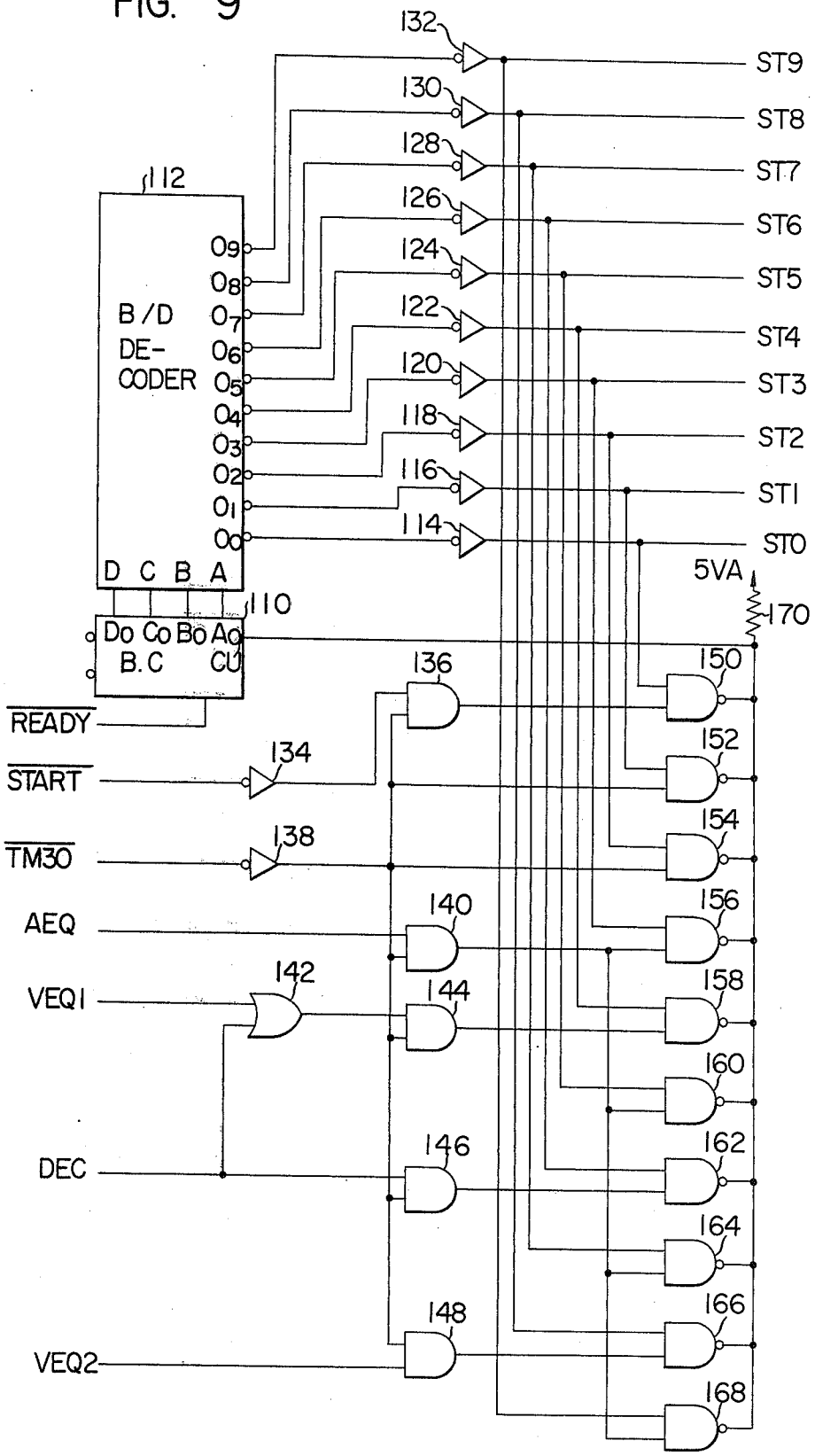
FIG. 9 is a circuit diagram of a status-of-operation signal generator used with the present invention.

The arrangement illustrated in FIG. 9 comprises a 4-bit binary counter 110 of the synchronous type such as commercially available under TTL-IC SN74193N from Texas Instruments Inc. and a binary-to-decimal decoder 112 connected in bit parallel relationship to the binary counter 110. The decoder 112 may be one manufactured under TTL-IC SN7442A by Texas Instruments Inc. A binary coded signal from the counter 110 is decoded by the binary-to-decimal decoder 112 to appear as a binary ZERO at a corresponding one of outputs $O_o$ through $O_9$ of the decoder 112. For example, with the elevator car stopped, the ready-for-operation signal $\overline{READY}$ has a value of binary ONE and the counter 110 is in its reset state so that the decoder 112 provides an output of binary ZERO at the output $O_o$. This output of binary ZERO is applied to an inverter 114 which, in turn, provides a status-of-operation signal ST0 having a value of binary ONE representing the operational state 0. As shown in FIG. 9, the remaining outputs $O_1$ through $O_9$ of the decoder 112 are connected to individual inverters 116 through 132 respectively.

If the car is to start, the ready-for-operation signal $\overline{READY}$ assumes the level of binary ZERO to put a start signal $\overline{START}$ at the level of binary ZERO. The binary zero signal $\overline{START}$ is applied via an inverter 134 to an AND gate 136 to open it. A timing signal TM30 that is the output from inverter 138 passes through the thus opened gate 136 and thence through a NAND gate 150 which is also supplied with the status-of-operation signal ST0 after which the timing signal enters a count input CU to the counter 110. Thus the counter 110 counts one pulse up to cause the inverter 116 connected to the output $O_1$ of the decoder 112 to provide an output or a status-of-operation signal ST1 having a value of binary ONE, at the output of the inverter 116.

In the operational state 1 the timing signal TM30 from the inverter 138 passes through a NAND gate 152 which is also supplied with the status-of-operation signal ST1. In the operational state 2 the timing signal TM30 passes through a NAND gate 154 having the status-of-operation signal ST2 applied thereto then it enters the count input CU of the counter 110. Each of the operational states 1 and 2, therefore, shifts to the next succeeding operational state after a time interval, in this case, 200 microseconds, equal to the pulse repetition period of timing signal TM30.

Operational state 3 is shifted to the operational state 4 by the opening of an AND gate 140 with an equality signal AEQ indicating that the absolute magnitude of command acceleration has become equal to the predetermined magnitude as will be described later and passing time signal TM30 through the opened gate 140 and then through a NAND gate 156 which is also supplied with the status-of-operation signal ST3, after which it enters the counter 110. This results in the status-of-operation signal ST4 appearing at the output of the inverter 118 to indicate that the operational state is shifted to the state 4.

In order to shift the operational state 4 to the next succeeding state 5, with no rated speed reached as shown in FIG. 2, the stop determination device 18 (see FIG. 4) first computes a point where the command acceleration is to decrease in order to cause the car to land at the desired floor and then issues a stop determination signal DEC. This signal DEC is passed through an OR gate 142 to open AND gate 144. This opening of the AND gate 144 permits the timing signal TM30 from the inverter 138 to pass through a NAND gate 148 which is also supplied with the status-of-operation signal ST4 to enter the counter 110. This results in the shift of the operational state 4 to the operational state 5 which is indicated by the status-of-operation signal ST5 appearing at the output of the inverter 124. For purposes of FIG. 4, the circuit configuration of the stop determination device 18 is not illustrated.

On the other hand, if the rated speed is reached as shown in FIG. 3, the actual car speed should be prevented from exceeding the rated speed. Therefore by issuing a signal VEQ1 (which will be described hereinafter) indicating that the command speed is equal in magnitude to the speed at the point where the command acceleration is to decrease or at the time point $T_2$ shown in FIG. 3, the shift of the status of operation is accomplished. That is, this signal VEQ1 is applied to the OR gate 142 to shift the operational state 4 to the state 5 in the same manner as above described in conjunction with the stop determination signal DEC.

The shift of the operational state 5 to the operational state 6, of state 7 to state 8 and of state 9 to the state 0 is accomplished by issuing respective equality signals AEQ indicating that the corresponding command accelerations have become equal to the respective predetermined magnitudes. Then the process as above described in conjunction with the first mentioned equality signal AEQ is repeated to effect the desired shift of the operational state.

To shift the operational state 6 to the state 7, the stop determination signal DEC as above described is operated to open an AND gate 146 to permit the timing signal TM30 to be applied to the counter 110 through a NAND gate 162 in a manner similar to that described above.

The shift of the operational state 8 to the state 9 is accomplished by issuing a signal VEQ2 (which will be described later) indicating that the command speed is equal in magnitude to the speed at the point where the command acceleration is to decrease to cause the car to land at the desired floor. This signal VEQ2 opens an AND gate 148 to permit the timing signal TM30 to be applied to the counter 110 through an AND gate 166 which is also supplied with the status-of-operation signal ST8. Therefore the timining signal TM30 similarly enters the counter 110 resulting in a shift of the operational state.

From the foregoing it is seen that the status-of-operation signals ST0, ST1, . . . ST8 and ST9 are developed from the inverters 114, 116, . . . 130 and 132 in the named order to indicate the corresponding operational state for the purpose of generating a command speed pattern as shown in FIG. 2 or 3.

The NAND gates 150 through 168 are of the open collector output type and form a so-called wired OR circuit by the application of an electric source 5VA to a resistor 70 connected to the outputs of all the NAND gates.

Figures 10A, 10C:
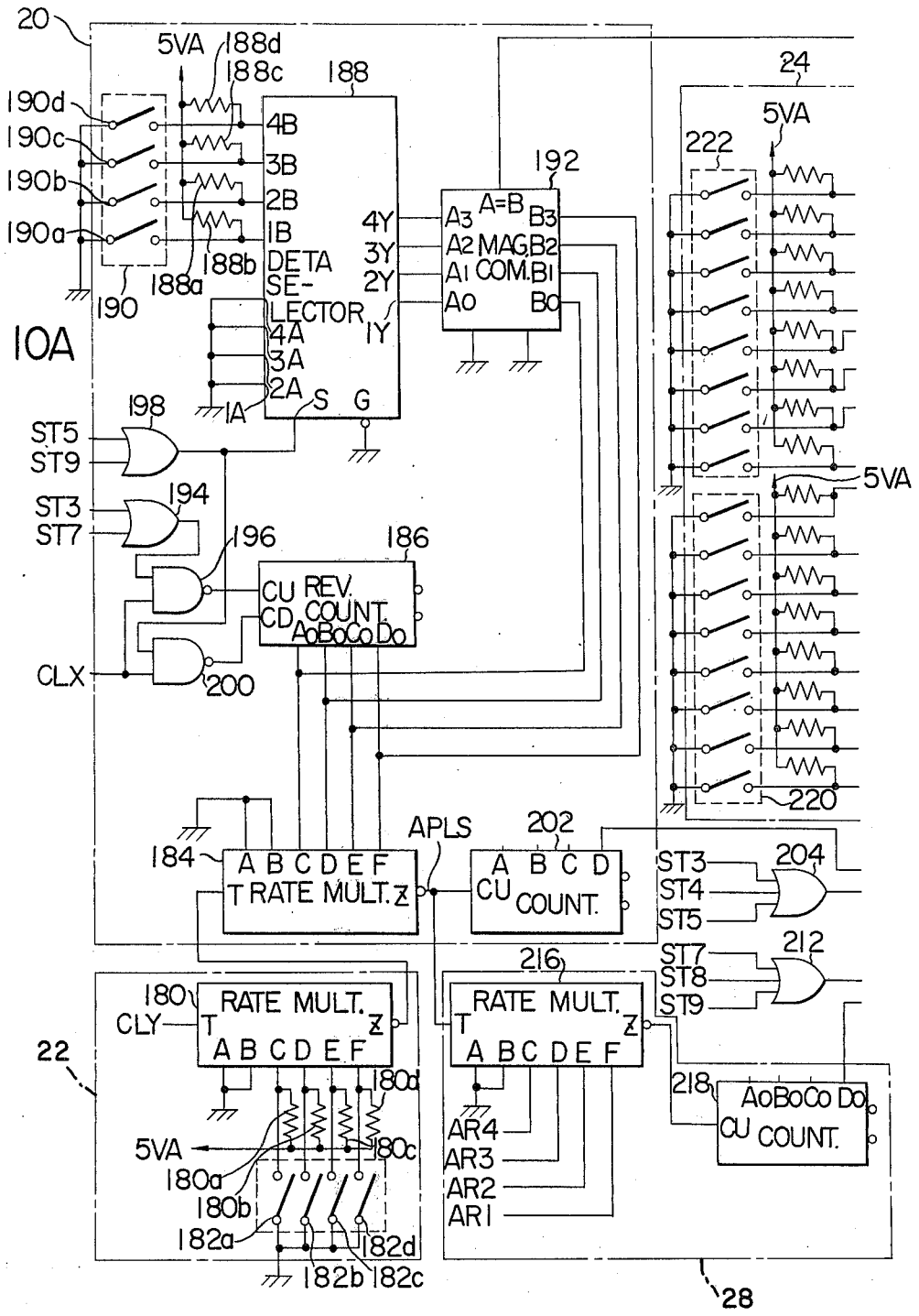
FIGS. 10A and 10B together are a circuit diagram of the acceleration pattern generator and the digital-to-analog converter with the intermediate components disposed therebetween as shown in FIG. 4.
FIG. 10C is a diagram illustrating the arrangement of FIGS. 10A and 10B.
Figure 10B:
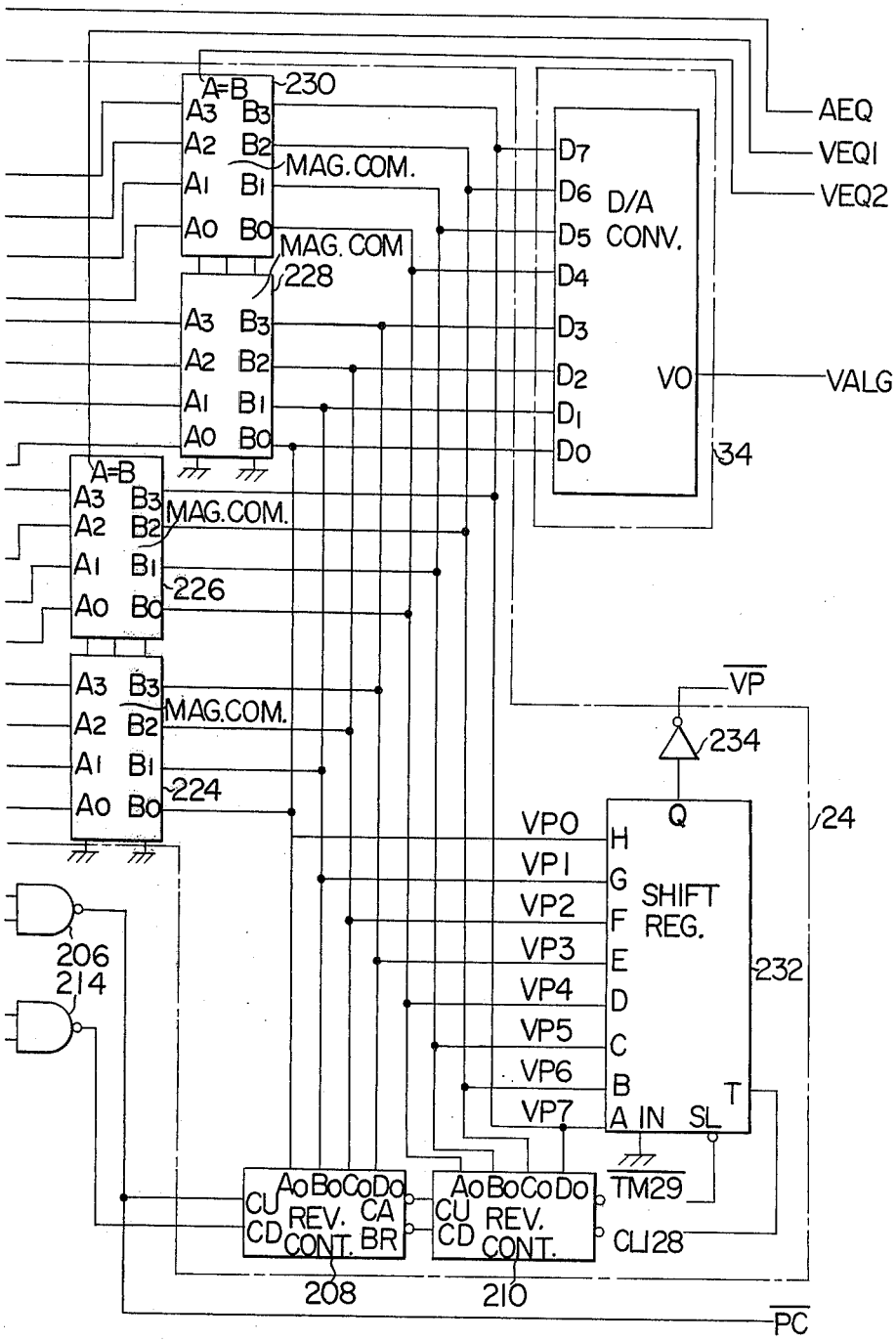

FIG. 10 shows the details of the essential circuitry for generating a command speed pattern including the acceleration pattern generator 20, the acceleration modifier 28, the first counter device 24 and the digital-to-analog converter 34. The arrangement illustrated comprises the basic clock pulse generator 22 including a synchronous 6-bit binary rate multiplier 180 such as commercially available under TTL-IC SN7497 from Texas Instruments Inc. and a switch bank 182 having a plurality, in this case, four of switches **182*a*, 182*b*, 182*c* and 182*d*. The switches 182*a*, 182*b*, 182*c* and 182*d* are connected at one end to ground and at their other ends to an electric source 5VA through respective resistors 180*a*, 180*b*, 180*c* and 180*d* and also to rate inputs, C, D, E and F of the rate multiplier 180. When open, the switches set values of binary ONE at the mating rate inputs and when closed, they set values of binary ZERO at the mating rate inputs because the mating rate inputs are connected to the electric source 5VA through the respective resistors. Thus the rate inputs C, D, E and F to the rate multiplier 180 can have a binary number $x$ as determined by the closure and opening of the switches 182*a*, 182*b*, 182*c* and 182*d* of the switch bank 182**.

For a given rate $x$, clock pulses CLY having a pulse repetition frequency of $f$ applied to the clock input T of the rate multiplier 180 produce from the output $z$ clock pulses CLY′ having a pulse repetition frequency of $xf/64$. These clock pulses CLY′ are shown in FIG. 7 as being the basic operation clock pulses CL128.

The clock pulses CLY′ are successively supplied to the acceleration pattern generator or first modulator 20 and strictly, to a 6-bit binary rate multiplier 184 similar to the rate multiplier 180 and including rate inputs C, D, E and F supplied from a 4-bit binary reversible counter 186 such as commercially available under TTL-TC SN74193 from Texas Instruments Inc.

The first modulator 20 further includes a quadruple 2-lines-to-1-line data selector 188 having one set of four parallel inputs 1A, 2A, 3A and 4A connected to ground and the other set of four parallel inputs 1B, 2B, 3B and 4B connected to a switch bank 190 having four switches **190*a*, 190*b*, 190*c* and 190*d* in the same manner as above described in conjunction with the switch bank 182. The data selector 188 may be commercially available, for example, under TTL-IC SN74157 from Texas Instruments Inc. and is operative to reproduce the input state of the inputs 1A, 2A, 3A and 4A at its parallel outputs 1Y, 2Y, 3Y and 4Y when the selection input S has a value of binary ZERO and the input state of the inputs 1B, 2B, 3B and 4B at the outputs 1Y, 2Y, 3Y and 4Y** when selection input S has a value of binary ONE.

The output from the data selector 188 is compared with an output from the counter 186 by a 4-bit binary magnitude comparator 192 such as marketed under TTL-IC SN7485 from Texas Instruments Inc.

After the elevator car has been started, the status-of-operation signal ST3 is passed through an OR gate 194 to open a NAND gate 196 in the operational state 3. Thus clock pulses CLX are successively entered into the UP input CU of the counter 186 through the thus opened gate 196. The clock pulses are formed by frequency dividing the pulse repetition frequency of the basic operation clock pulses CL128 and in this case have a pulse repetition period of 102.4 milliseconds. Under these circumstances, the output from the counter 186 is increased stepwise and the basic acceleration clock pulses CLY′ is frequency modulated by the rate multiplier 184. Thus the output from the rate multiplier 184 has a pulse repetition frequency which is linearly increased from its null magnitude.

On the other hand, since an OR gate 198 has an output of binary ZERO except for the operational states 5 and 9, the data selector 188 receives at the selection input S a binary ONE and produces at its parallel outputs 1Y, 2Y, 3Y and 4Y a replica of the input states at the rate inputs 1B, 2B, 3B and 4B as determined by the operation of the switch bank 190. The switch bank 190 is set to provide a 4-bit maximum acceleration for the car. Therefore the magnitude comparator 192 compares the maximum acceleration from the data selector 188 with a 4-bit count from the counter 186 to generate an equality signal AEQ when the two are equal to each other.

As above described in conjunction with FIG. 9, this equality signal AEQ shifts the operation to the operational state 4 to stop the operation of the counter 186 and then the occurrence of a stop determination signal DEC results in a shift to a the operational status 5. This permits a status-of-operation signals ST5 to pass through the OR gate 198 to impart to the selection input S of the data selector 188 a binary ONE. Thus the state of the inputs 1A, 2A, 3A and 4A of the data selector 188 indicating a null acceleration is transferred to the magnitude comparator 192. Also the output binary ONE from the OR gate 198 opens the NAND gate 200 to permit the clock pulses CLX to successively enter the DOWN input CD of the reversible counter 186. Accordingly, the counter 186 begins to count pulses down. Upon the counter 186 providing a null output, the magnitude comparator 192 delivers an equality signal AEQ resulting in a shift to the status of operation 6. At that time the status of operational state is immediately shifted to the operational state 7 because of the presence of the stop determination signal DEC.

In the operational state 7, a status-of-operation signal ST7 is passed through the OR gate 194 to open the NAND gate 196. This causes the counter 186 to count pulses up. In this case the magnitude comparator 192 compares the count of the counter 186 with the maximum magnitude of acceleration as preset by the switch bank 190 until an equality signal AEQ is produced by the comparator 192 to shift the operational state 7 to the next succeeding state 8. At that time the counter 186 ceases counting the pulses.

When the command speed reaches a magnitude at the time point T6 as shown in FIG. 3, the operation is shifted to the operational state 9. Then the status-of-operation signal ST9 passes through the OR gate 198 to open the NAND gate 200. Thus the counter 186 again counts down the clock pulses CLX. When the count on the counter 186 reaches zero, the comparator 192 produces similarly an equality signal AEQ whereupon the operation is returned back to the operational state 0 and also the counter 186 ceases counting down the clock pulses CLX.

In this way the counter 186 produces an output having a waveform equal to the acceleration waveform $OHIT_3T'_3KLT_7$ as shown in FIG. 3 and the basic acceleration clock pulses CLY' has a pulse repetition frequency modulated into a similar form by the rate multiplier 184. The pulses APLS from the rate multiplier 184 thus modulated are frequency divided to one sixteenth the original frequency by a 4-bit counter 202.

In the operational states 3, 4 and 5 the status-of-operation signals ST3, ST4 and ST5 pass through an OR gate 204 to open a NAND gate 206. Those gates form the gate means G1 shown in FIG. 4. Under these circumstances, the pulses from the counter 202 are permitted to pass through the thus opened NAND gate 206 to an UP input CU of a 4-bit reversible counter 208 forming a first 8-bit reversible counter with another 4-bit reversible counter 210 serially connected to the counter 208. This 8-bit counter forms the input means to the first counter device 24 as shown in FIG. 4.

In the operational states 7, 8 and 9, however, the status-of-operation signal ST7, ST8 and ST9 pass through an OR gate 212 to open a NAND gate 214. Those gates form the gate means G2 shown in FIG. 4. The modulated pulses APLS from the rate multiplier 184 are also applied to the second modulator 28 and strictly to a rate multiplier 216 similar to the rate multiplier 184 to be gain frequency modulated with a rate determined by a binary number applied to four rate inputs, C, D, E and F of the multiplier 216 dependent upon a 4-bit acceleration rate signal AR1, AR2, AR3 and AR4 as will be described hereinafter. Then the frequency modulated signal from the rate multiplier 216 is frequency divided to one eighth its frequency by a 4-bit counter 218 similar to the counter 202. The frequency divided pulse signal from the counter 218 is applied through the thus opened NAND gate 214 to a DOWN input CD of the first 8-bit counter 208–210.

As a result, the first counter 208–210 produces an 8-bit binary output representing the command speed pattern such as shown by $OABCC_oE'T_7$ in FIG. 3. This 8-bit binary output is supplied to the decimal-to-analog converter 34 shown in FIG. 10 as being of an 8-bit type including eight parallel inputs $D_o$ through $D_7$. In the converter 34 the 8-bit output is converted to a corresponding analog signal VALG that is developed at its output V0.

The first counter device 24 further includes a pair of switch banks 220 and 222 each including a plurality, in this case, eight of switches connected to an associated magnitude comparator and an electric source in a manner similar to that described above in conjunction with the switch bank 182. The switch bank 220 is operative to determine that magnitude of the command speed at a point or the time point $T_2$ (see FIG. 3) when the acceleration is decreased in order to prevent the actual speed from exceeding its rated speed during an operation reaching the rated speed. The magnitude of the command speed as determined by the switch bank 220 is applied to eight parallel A inputs of an 8-bit magnitude comparator, shown in FIG. 10 as being formed of two serially connected 4-bit magnitude comparators 214 and 216 each similar to the magnitude comparator 192. The 8-bit comparator 224–226 compares the 8-bit output from the counter 208–210 at the B inputs thereof with the command speed just described to produce at its output A = B a signal VEQ1 for shifting the operation from the state 4 to 5 in response to the output from the counter equaling the command speed.

On the other hand, the switch bank 222 is operative to determine that magnitude of the command speed at the time point $T_6$ (see FIG. 3) where the acceleration is decreased during the deceleration. This magnitude of the command speed is applied to eight parallel A inputs of an 8-bit magnitude comparator, shown in FIG. 10 as being formed of two serially connected 4-bit magnitude comparators 228 and 230 each similar also to the magnitude comparator 192. The 8-bit comapator 228–230 compares the 8-bit output from the counter 208–210 with the command speed resulting from the switch bank 222 to produce at its output A = B a signal VEQ2 for shifting the operation from the state 8 to 9 when the output from the counter equals the command speed.

The 8-bit output labelled VP0 through VP7 from the counter 208–210 is also supplied to an 8-bit shift register 232 such as commercially available under TTL-IC SN74166 from Texas Instruments Inc. The shift register 232 includes eight parallel inputs A through H supplied with the eight bits VP0 through VP7 from the output of the first counter 208–210 respectively, a loading input SL for parallel signal supplied with a timing signal TM02 (see FIG. 7) and a clock input T supplied with the basic operation clock pulses CL128. When the loading input SL has a value of binary ZERO, data applied to the parallel inputs A through H is registered or loaded into the shift register 232 and eight bits of a corresponding command speed signal are serially developed at the output Q of the register 232 for a time interval between the time slots 3 and 10 of the fundamental operating period (see FIG. 7), one bit for each time slot. This command speed signal passes through an inverter 234 to form a series command speed signal $\overline{VP}$ which represents the content of the counter 208–210.

This series command speed signal $\overline{VP}$ is integrated into a distance signal SI by the integrator 36 (see FIG. 4). In order to calculate the residual distance to a desired floor, the command speed signal VP is required to be expressed in the same units as the series actual position signal SP from the shift register 86 for the actual position as shown in FIG. 8.

In the example illustrated, the basic acceleration pulses CLY' from the rate multiplier 180 have a pulse repetition frequency $f_o$ as determined by the fundamental operating period, the rated speed $V_{max}$ in meters per second, the magnitude ΔS in meters for each positional pulse 60*a* or 60*b* from the pulse generator 60 (see FIG. 8) calculated in terms of a distance (the generator senses the distance of movement of the elevator car), the maximum amplitude $A_{max}$ in meters per second per second of the command acceleration pattern, and the rate of change of acceleration, in meters per second per second per second, with respect to time. For example, it is assumed that the rated speed $V_{max}$, the maximum acceleration $A_{max}$, the rate of acceleration change J and the distance ΔS corresponding to each positional pulse have respectively following magnitudes:

$$V_{max} = 300 \text{ m/min} = 5 \text{ m/sec}, A_{max} = 1 \text{ m/sec}^2,$$

$$J = 1 \text{ m/sec}^3 \text{ and } \Delta S = 5 \times 10^{-3}\text{m}.$$

It is also assumed that the clock pulses CLX counted by the counter 186 have a pulse repetition period of 102.4 milliseconds resulting from the frequency division of the basic operation clock pulses CL128 and that the switch bank 190 sets a maximum magnitude of 10 of the acceleration on the data selector 188. Under the assumed conditions, the command acceleration pattern such as shown by $OHIT_3$ in FIG. 3 has a maximum acceleration of substantially 1 m/sec$^2$ and a rate of change of acceleration of about 1 m/sec$^3$. The pulse repetition frequency $f_o$ of the basic acceleration pulses CLY' will now be found under the conditions as above described.

Since it is assumed that the positional pulse 60*a* or 60*b* (see FIG. 8) has a pulse repetition frequency of 1,000 hertz during the travel at the rated speed, the number of the series distance-of-movement signals SI from the integrator 36 must increase with increments of 1,000 per second. Also assuming that the signal SI has the least significant bit of the binary numbers in the time slot 13, the series command speed signals $\overline{VP}$ supplied to the integrator 36 has also the least significant bit of binary numbers in the time slot 13. Accordingly the series command speed signals $\overline{VP}$ require the content corresponding to 0.2 in view of the fundamental operating period of 200 microseconds.

On the other hand, the first counter 208–210 is required to deliver a binary number approximating the maximum decimal number 255 or the binary number 11111110 during the travel at the rated speed in order to efficiently operate the counter 208–210. Accordingly converting the 8-bit command speed signal from the counter 208–210 to a series binary signal within the fundamental operating period requires only the time interval between the time slot 3 and the time slot 10.

When the binary numbers have the least significant bit in the time slot 13, the time slot 3 is that bit position corresponding to $2^{-10}$. This means that, during travel at the rated speed the 8-bit output from the counter 208–210 has a content of $0.2/2^{-10} \approx 205$. This figure is equal to the number of the pulses entering the counter 208–210 until the command speed reaches its rated magnitude.

From the foregoing it is seen that by considering that the rate multiplier 180 has a rate of frequency conversion of 10/16 and that the counter 202 has a ratio of frequency division of 1/16 for adjusting the spacing between adjacent pulses from the rate multiplier 180, the basic acceleration pulses CLY' have a pulse repetition frequency of $f_o$ satisfying $$0.2/2^{-10} = f_o \times \frac{V_{max}}{A_{max}} \times \frac{10}{16} \times \frac{1}{16}$$

That is, $f_o$ is about 1050 hertz.

Assuming that the clock signal CLY is formed of clock pulses with a pulse repetition frequency of 1,250 hertz provided by frequency dividing the basic operation clock pulses CL128, the parallel inputs C, D, E and F of the rate multiplier 180 which determines the pulse repetition frequency of the basic acceleration pulses have applied thereto a rate of frequency conversion AC calculated at $$AC = 16 \times f_o/1250 \approx 13$$

This figure can readily be set by the associated switch bank 182. It will readily be understood that the frequency $f_o$ of the basic acceleration pulses can increased in accuracy by increasing the number of bits of the rate of frequency conversion or the number of the parallel inputs to the rate multiplier 180 with the number of the switches of the switch bank 182 increased correspondingly.

Figure 11A:
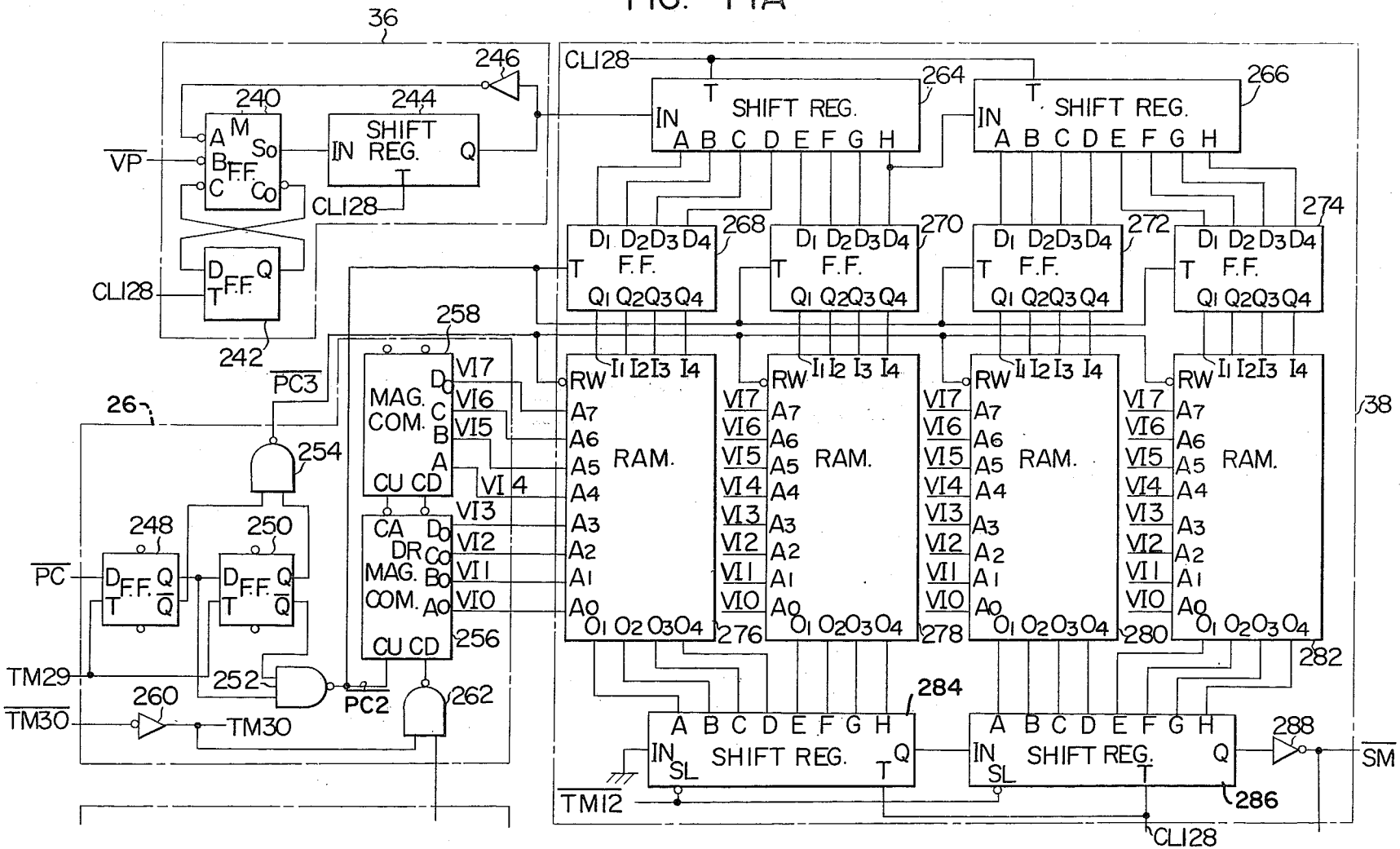
FIGS. 11A and 11B together are a circuit diagram of the distance-of-movement memory and the associated components shown in FIG. 4.
Figures 11B, 11C:
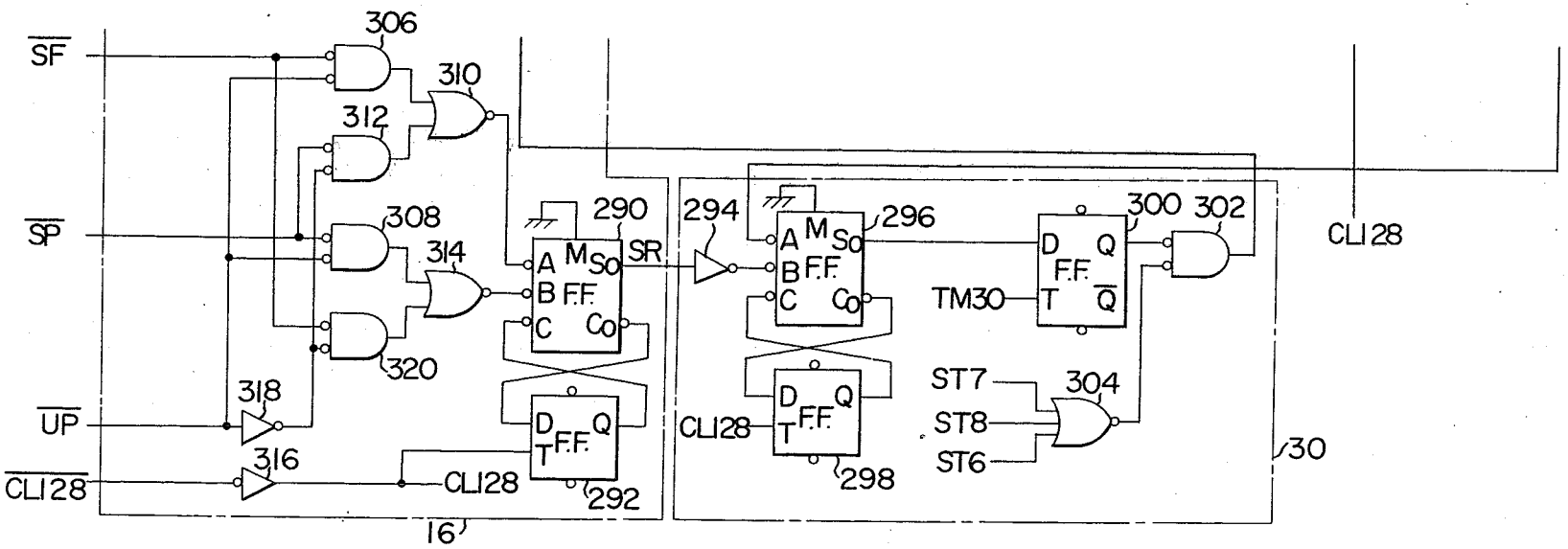
FIG. 11C is a diagram illustrating the arrangement of FIGS. 11A and 11B.

FIG. 11 illustrates the details of the integrator 36, the distance-of-movement memory 38, the distance comparator 30, substracter 16 and the second counter device 26 shown in FIG. 4. In FIG. 11 the integrator 36 is shown as including a full adder 240, a D FLIP-FLOP 242 and a 32-bit shift register 244. This is similar in both construction and connection to the full adder/subtracter 80, the D FLIP-FLOP 82 and the shift register 86 shown in FIG. 8 except that in FIG. 11, the shift register 244 has the output Q returned back to the addition input A of the adder 240 through an inverter 246 and the selection input M is maintained inoperative. The basic operation clock pulses CL128 are successively applied to the clock inputs T of the FLIP-FLOP 242 and the shift register 244. The adder 242 acts as a series adder and also forms a series 32-bit integrator circuit with the shift register 244 and the inverter 246 because of the presence of the feedback circuit with the inverter 246.

The series command speed signal $\overline{VP}$ from the inverter 234 (see FIG. 10) is supplied to the adder 240 at the addition input B to be integrated into a distance-of-movement signal SI that is in turn to be developed at the output Q of the register 244. The distance-of-movement signal SI represents a theoretical distance of movement dependent upon the command speed signal.

As shown in FIG. 11, the second counter device 26 includes a pair of D FLIP-FLOP's 248 and 250 and a NAND gate 252 similar in both construction and connection to the D FLIP-FLOP's 64 and 66 and the NAND gate 68 as shown in FIG. 8 and another NAND gate 254 having inputs connected to the Q output of the FLIP-FLOP 248 and the $\overline{Q}$ output of FLIP-FLOP 250.

The pulse signal $\overline{PC}$ from the NAND gate 206 counted by the first register 208–210 (see FIG. 10) is applied to the input D of the FLIP-FLOP 248 and triggered with the timing signal TM29 applied to the clock inputs T of the FLIP-FLOP's 248 and 250 to provide a pulse signal PC2 at the output of the NAND gate 252 at the rise of the signal $\overline{PC}$ in synchronization with the timing signal TM29. The pulse signal PC2 has a pulsewidth corresponding to the fundamental operating period. The pulse signals $\overline{PC2}$ are successively applied to the UP input CU to a second 8-bit reversible counter formed of a pair of 4-bit reversible counters 256 and 258 similar to the 4-bit reversible counters 208 and 210 (see FIG. 10) respectively and counted. Therefore the second counter 256–258 is identical in output to the first counter 208–210 in the acceleration region or in the operational states 3, 4 and 5.

Further the timing signal $\overline{TM30}$ is applied via an inverter 260 to one input of NAND gate 262 connected to the DOWN input of the counter 256 for a purpose which will later be apparent.

On the other hand, the distance-of-movement signal SI from the shift register 244 is supplied to an input IN of an 8-bit shift register 264 included in the distance-of-movement memory 38. The shift register 264 may be commercially available under TTL-IC SN74164 from Texas Instruments Inc. and includes eight parallel output A through H with the outputs H connected to an input IN of a similar shift register 266. The registers 264 and 266 have respective clock inputs T successively receiving the basic operation clock pulses CL128 and cooperate with each other to convert the series signal SI into a corresponding 16-bit parallel signal having the least significant position in the time slot 13. As shown in FIG. 11, four quadruple D FLIP-FLOP's 268, 270, 272 and 274 such as marketed under TTL-IC SN74175 from Texas Instruments Inc. are connected to the shift registers 264 and 266 two for each register and the pulse signal $\overline{PC2}$ from the NAND gate 252 synchronized with the timing signal TM29 is applied to the clock input T of each FLIP-FLOP to hold the 16-bit parallel signal therein.

The FLIP-FLOP's 268, 270, 272 and 274 are connected in 4-bit parallel relationship to an array of 4-bit, 256 word static random acess memories, 276, 278, 280 and 282 respectively. Each of those memories (which is abbreviated hereinafter to "RAM") includes a control input RW for controlling writing-in and reading-out so that, when the input RW has a value of binary ZERO, the four bits applied to the four inputs $I_o$, $I_2$, $I_3$ and $I_4$ from the outputs $O_1$, $O_2$, $O_3$ and $O_4$ of the associated FLIP-FLOP are simultaneously written therein at an address defined by eight address bits VI0 through VI7 supplied to the eight address inputs $A_o$ through $A_7$ from outputs of the second counter 256–258. In order to apply a binary ZERO to the control input RW a pulse signal $\overline{PC3}$ is produced at the output of the NAND gate 254 at the fall of the pulse signal $\overline{PC}$ and in synchronization with the timing signal TM29. The pulse signal $\overline{PC3}$ thus produced has a pulsewidth corresponding to the fundamental operating period and is applied to the control input RW of each RAM". When the control input RW has a value of binary ONE, data stored at the address in each RAM corresponding to the eight address bits VI0 to VI7 can be read out through the four-parallel outputs $O_1$, $O_2$, $O_3$ and $O_4$, one for each bit.

From the foregoing it will be appreciated that in the operational states 3, 4 and 5 the array of the four RAM's 276, 278, 280 and 282 store the 16-bit parallel distance-of-movement signals held in the four FLIP-FLOP's 268, 270, 272 and 274 at the address determined by the output from the second counter 256–258 one after another each time the second counter counts one pulse up. As a result, the array of RAM's store the relationship between the command speed and the distance of movement in the form of a speed-distance function.

The outputs $O_1$, $O_2$, $O_3$ and $O_4$ of RAM's 276 and 278 are connected to eight parallel inputs A, B, C, E, F, G and H of an 8-bit shift register 284 while the outputs of RAM's 280 and 282 are similarly connected to a similar shift register 286 serially connected to the shift register 284. The shift register 286 is connected at its output Q to an inverter 288.

In FIG. 11, the subtracter device 16 is shown as including a series subtracter formed of a subtracter 290 and a D FLIP-FLOP 292 similar in both construction and connection to the adder/subtracter 80 and the FLIP-FLOP 82 as shown in FIG. 8 except that in FIG. 11 the selection input M is connected to ground.

The distance comparator 30 is shown in FIG. 11 as including an inverter 294, a series subtracter 296 identical to the series subtracter 290 and having an input B connected to the output of the inverter 294. The subtracter 296 is connected at the operation output $S_o$ to an input of a D FLIP-FLOP 300 which has an output Q connected to one input to a NOR gate 302. The other input to the gate 302 is connected to an output of a NOR gate 304.

During the upward travel of the elevator car, an UP travel signal $\overline{UP}$ having a value of binary ZERO is applied to NOR gates 306 and 308 to open them. Next, a stop floor signal $\overline{SF}$ is passed through the thus opened gate 306 and thence to a NOR gate 310 until it enters input A of the subtracter 290. The stop floor signal $\overline{SF}$ is produced by the stop determination device 18 (see FIG. 4) to form a binary floor position signal in the form of thirty-two series bits indicating the distance between the reference floor such as the lowermost floor and that floor where the car will stop. This distance is expressed in terms of unit position pulses having the least significant bit in the time slot 13. Also the actual position signals $\overline{SP}$ is applied to a NOR gate 308 to open it and is then passed through a NOR gate 314 to the input B of the substracter 290. The clock pulses CL128 from an inverter 316 are applied to the clock input T of the FLIP-FLOP 292 while the substracter 290 substracts the actual position signal $\overline{SP}$ from the stop floor signal $\overline{SF}$ to produce at the operation output $S_o$ a residual distance signal SR indicating the residual distance to the desired floor.

During the downward travel, the $\overline{UP}$ travel signal UP has a value of binary ONE and therefore opens the NOR gate 312 and another NOR gate 320 through an inverter 318. This permits the actual position $\overline{SP}$ to enter the input A and the stop floor signal $\overline{SF}$ to enter the input B of the subtracter 290. The subtracter 290 subtracts the signals $\overline{SP}$ from the signals $\overline{SF}$ but it is noted that the subtracter 290 is designed and constructed such that the output therefrom is always a positive value.

When the elevator car enters the deceleration region or the operational states 7, 8 and 9, the UP signal $\overline{PC}$ counted by the second counter 256–258 becomes a binary ONE whereupon that counter terminates counting. At the same time, the control inputs RW to the RAM's 276, 278, 280 and 282 becomes a binary ONE to put the RAM's in the read out mode of operation. Then the 16-bit parallel distance-of-movement signal last stored at the address determined by the 8-bit speed signal VI formed of the last outputs VI0, VI2, VI3, VI4, VI5, VI6 and VI7 delivered from the second counter 256–258 in the acceleration region or the operational state 5 is read out through the outputs of the array of RAM's and supplied in parallel relationship to a pair of serially connected 8-bit shift registers 284 and 286 having the basic operation clock pulses CL128 and the timing signals $\overline{TM12}$ applied thereto. In the serially connected shift registers 284 and 286 the 16-bit parallel distance-of-movement signal is converted to a 16-bit series signal by means of the timing signal $\overline{TM12}$, the 16-bit series signal having the least significant bit in the time slot 13 of the fundamental operating period. This series signal is applied to the inverter 288 and developed as a stored series distance-of-movement signal SM at its output.

This signal $\overline{SM}$ is applied to the input A of the subtracter 296, while the residual distance $\overline{SR}$ is applied to the input B as above described. Thus a difference signal between the signals $\overline{SM}$ and $\overline{SR}$ appears at the operation output $S_o$ of the subtracter 296.

Since the signal $\overline{SR}$ is larger than the signal SM at first, the subtracter 296 provides negative signals at the output $S_o$ thereof. Further this signal is a very large binary number sufficient to have a binary ONE at all bit positions up to the most significant bit. Therefore the timing signal TM30 appearing in the time slot 30 of the fundamental operating period is applied to the clock input T of the FLIP-FLOP 300 to trigger it whereby a value of binary ONE appears at the output Q of the FLIP-FLOP 300.

On the other hand, once the signal $\overline{SR}$ becomes smaller than the signal $\overline{SM}$, the subtracter 296 provides a positive binary number at its output $S_o$. This binary number is small enough to have values of binary ZERO at upper bits thereof, and therefore the FLIP-FLOP 300 immediately provides a value of binary ZERO at the output Q thereof.

Simultaneously, the status-of-operation signals ST7, ST8 and ST9 can open the NOR gate 302 through the NOR gate 304 when in the deceleration region. The signal $\overline{SR}$ is smaller than the signal SM and causes the gate 302 to provide a value of binary ONE at the output thereby to open the NAND gate 262. The opening of the NAND gate 262 permits the timing signal TM30 to pass to the DOWN input CD of the second counter 256–258. This results in counting-down operation of the second counter.

From the foregoing it is seen that, each time the signal $\overline{SR}$ becomes smaller than signal $\overline{SM}$, the second counter 256–258 is initiated to count pulses down with the result that the second counter 256–258 produces an ideal speed relative to a corresponding residual distance to the particular stop floor, following the relationship between the distance and speed stored in the array of RAM's 276, 278, 280 and 282. In other words, the output from the second counter 256–258 forms an ideal speed for the elevator car.

Figure 12:
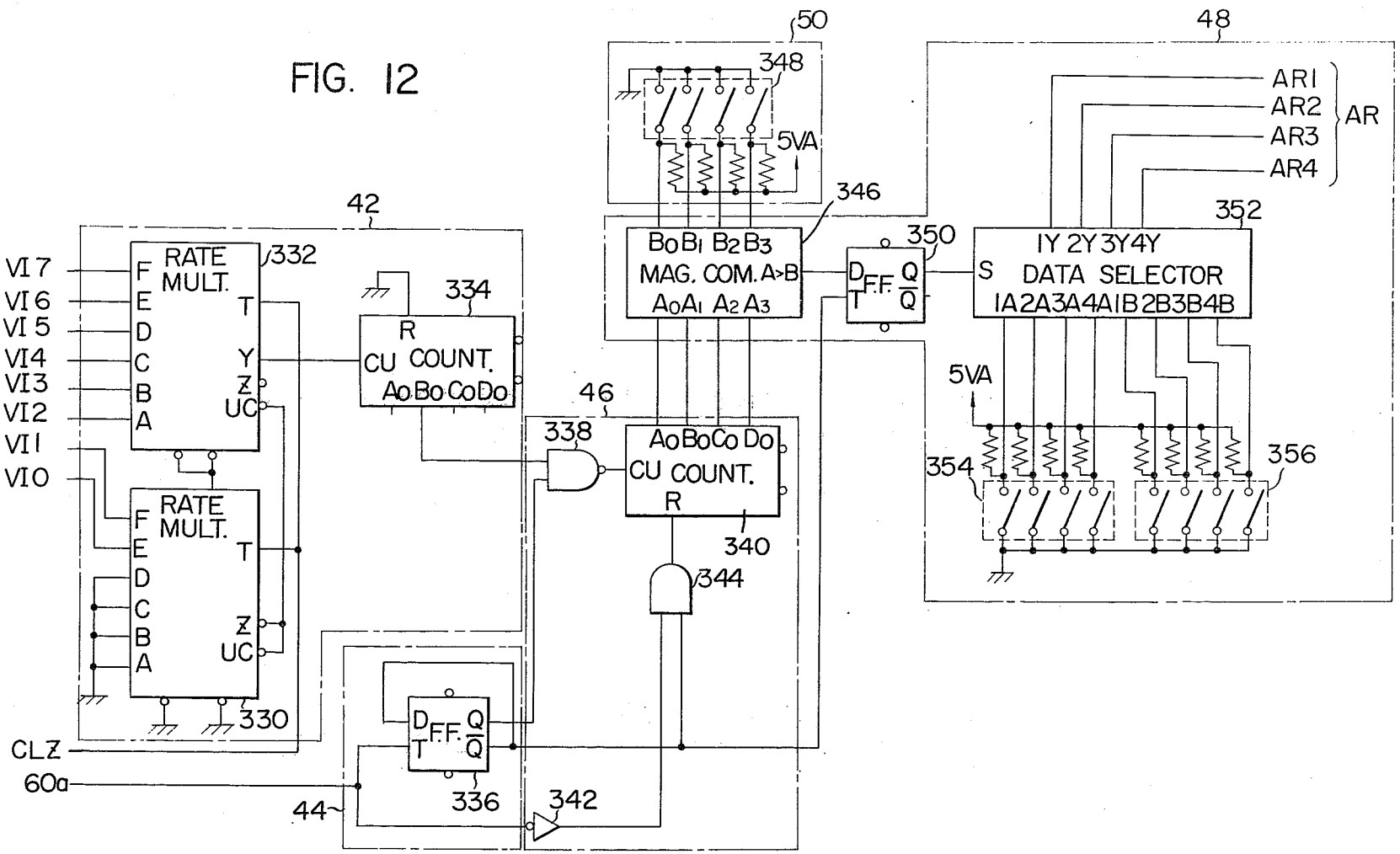
FIG. 12 is a circuit diagram of the speed comparator shown in FIG. 4.

FIG. 12 shows the details of the speed comparator 32 as shown in block form in FIG. 5. In FIG. 12 the third modulator 42 illustrated in FIG. 5 is shown as including a pair of rate multipliers 330 and 332 serially interconnected and a binary counter 334 connected to the rate multiplier 332 at the output Y. Each multiplier is similar to the rate multiplier 180 as shown in FIG. 10 and the counter 334 is similar to the counter 202 as also shown in FIG. 10. The rate multiplier 330 includes four inputs A, B, C and D connected together to ground and two inputs E and F having applied thereto two bits VI0 and VI1 of the ideal speed $V_I$ from the outputs $A_o$ and $B_o$ of the counter 256 (see FIG. 11) and the rate multiplier 332 includes six inputs A, B, C, D, F and F having applied thereto the bits VI2 and VI3 thereof from the outputs $C_o$ and $D_o$ of the counter 256 and the bits VI4, VI5, VI6 and VI7 of the ideal speed VI from the outputs A, B, C and D of the counter 258 (see FIG. 11) respectively. Both rate multipliers include clock input T to which clock pulses CLZ are applied. The clock pulses CLZ are A clock pulses with a pulse repetition frequency of $f_o$ generated by the A clock generator 40 shown in FIG. 5. The serially connected rate multipliers 330 and 332 are operative to convert the pulse repetition frequency $f_o$ of the clock pulses CLZ to a pulse repetition frequency proportional to the binary number formed of the 8-bits VI0 through VI7 of the ideal speed $V_I$ from the second counter 256–258 (see FIG. 11) and produce the clock pulses CLZ thus converted in frequency from the output Y.

The frequency converted clock pulses are successively applied to the counter 334 to be frequency divided to one quarter the frequency thereof in order to shape them into waveforms spaced away from one another by substantially equal intervals. The clock pulses from the counter 334 form B clock pulses having a pulse repetition frequency $f_1$ proportional to the ideal speed $V_I$ as above described, and are applied to a NAND gate 338.

The positional pulses **60*a* from the pulse generator 60 (see FIG. 8) are successively applied to a clock input T of a D FLIP-FLOP 336 which includes an input D connected to an output $\overline{Q}$ thereof and forming the frequency divider 44 (see FIG. 5). In the FLIP-FLOP 336 the frequency of the positional pulses 60*a* is halved. The NAND gate 338 has one input connected to the output of FLIP-FLOP 336 and a binary ONE at the output Q of the FLIP-FLOP 336 causes opening of NAND gate 338. The opening of the gate 338 permits the B clock pulses to successively enter a binary counter 340**.

The positional pulses **60*a* are also applied through an inverter 342 to one input of an AND gate 344 which in turn produces the logic product of the positional pulse $\overline{60a}$ and the Q output of the FLIP-FLOP 336 serving to reset the counter 340. In other words, each time one pair of adjacent positional pulses 60*a*** open the NAND gate 338, the counter 340 counts the B block pulses for one complete period of the first pulse 60*a* and is reset within the latter half of one complete period of the second pulse 60*a* by the output from the AND gate 344.

A 4-bit count from outputs $A_o$, $B_o$, $C_o$ and $D_o$ of the counter 340 is applied to one set of inputs $A_o$, $A_1$, $A_2$ and $A_3$ of magnitude comparator 346 similar to the magnitude comparator 192 (see FIG. 10). The comparator 346 also includes another set of inputs $B_o$, $B_1$, $B_2$ and $B_3$ connected to respective switches of a switch bank 348 connected between an electric source 5VA and ground in the same manner as the switch bank 182 as shown in FIG. 10. The switch bank 348 forms the constant register 50 as shown in FIG. 5 and imparts to the inputs $B_o$, $B_1$, $B_2$ and $B_3$ of the comparator 346 the constant $K_o$ as described above through the closure and opening of the switches. The comparator 346 compares the count from the counter 340 with the constant $K_o$ by the switch bank 348. When the count from the counter 340 is larger than the constant $K_o$, the comparator 346 provides a binary ONE at its output $A > B$ connected to the input D of a D FLIP-FLOP 350 which has a clock input T connected to the output $\overline{Q}$ of the FLIP-FLOP 336.

The output status at the output $A > B$ of the comparator 346 is determined at the rise of $\overline{Q}$ output from the FLIP-FLOP 336, that is, upon the completion of the count by the counter 340 and is developed at an output Q of the D FLIP-FLOP 350.

The output Q of the FLIP-FLOP 350 is connected to a selection input S of a quadruple 2-line to 1-line data selector 352 similar to the data selector 188 (see FIG. 10). The selector 352 includes one set of four inputs 1A, 2A, 3A and 4A connected to a switch bank 354 in the same manner as the inputs 1B, 2B, 3B and 4B to the data selector 188 and another set of four inputs 1B, 2B, 3B and 4B similarly connected to another switch bank 356. The switch bank 354 is operative to preliminarily set at the inputs 1A, 2A, 3A and 4A of the selector 352 a binary number $A_L$ larger than the binary number 1000 (or a decimal number 8) while the switch bank 356 preliminarily sets at the inputs 1B, 2B, 3B and 4B thereto a binary number $A_s$ less than the binary number 1000. This is because 4-bit binary numbers have a central value of decimal 8.

With a value of binary ZERO applied to its selection input S, the selector 352 selects the binary number $A_L$ applied to the inputs 1A, 2A, 3A and 4A while, with a value of binary ONE applied to the selection input S, it selects the binary number $A_s$ applied to the inputs 1B, 2B, 3B and 4B.

More specifically, when the count from the counter 340 is larger than the constant $K_o$, that is to say, where the actual speed is smaller than the command speed provided by the second counter 256–258 (see FIG. 10), a binary ONE is developed from the output Q of the FLIP-FLOP 350. Therefore the data selector 352 selects the binary number $A_s$ less than the central value to supply it to the acceleration modulator 28 (see FIG. 4) or the rate multiplier 216 (see FIG. 10) as an acceleration rate signal AR formed of four bits AR1, AR2, AR3 and AR4.

Referring back to FIG. 10 the rate signal at the rate input AR1, AR2, AR3 and AR4 rate multiplier 216 in this case is made less than the central value to decrease the frequency of the output pulses developed at the output z of the multiplier 216 with the result that the command speed from the first command speed counter 208–210 decreases in slope.

On the contrary, if the actual speed is higher than the speed from the second counter 256–258 (see FIG. 11) then the selector 352 selects the binary number $A_L$ larger than the central value to supply it to the rate multiplier 216. This means that the output pulses from the rate multiplier 216 increases in frequency with the result that the command speed from the first counter 208–210 has a greater slope.

In this way the actual speed is always compared with the ideal speed from the second counter 256–258 in the deceleration region until the desired stop floor is reached. According to the result of the comparison the command acceleration is modified to cause the actual speed to follow the ideal speed from the second counter.

Figure 13:
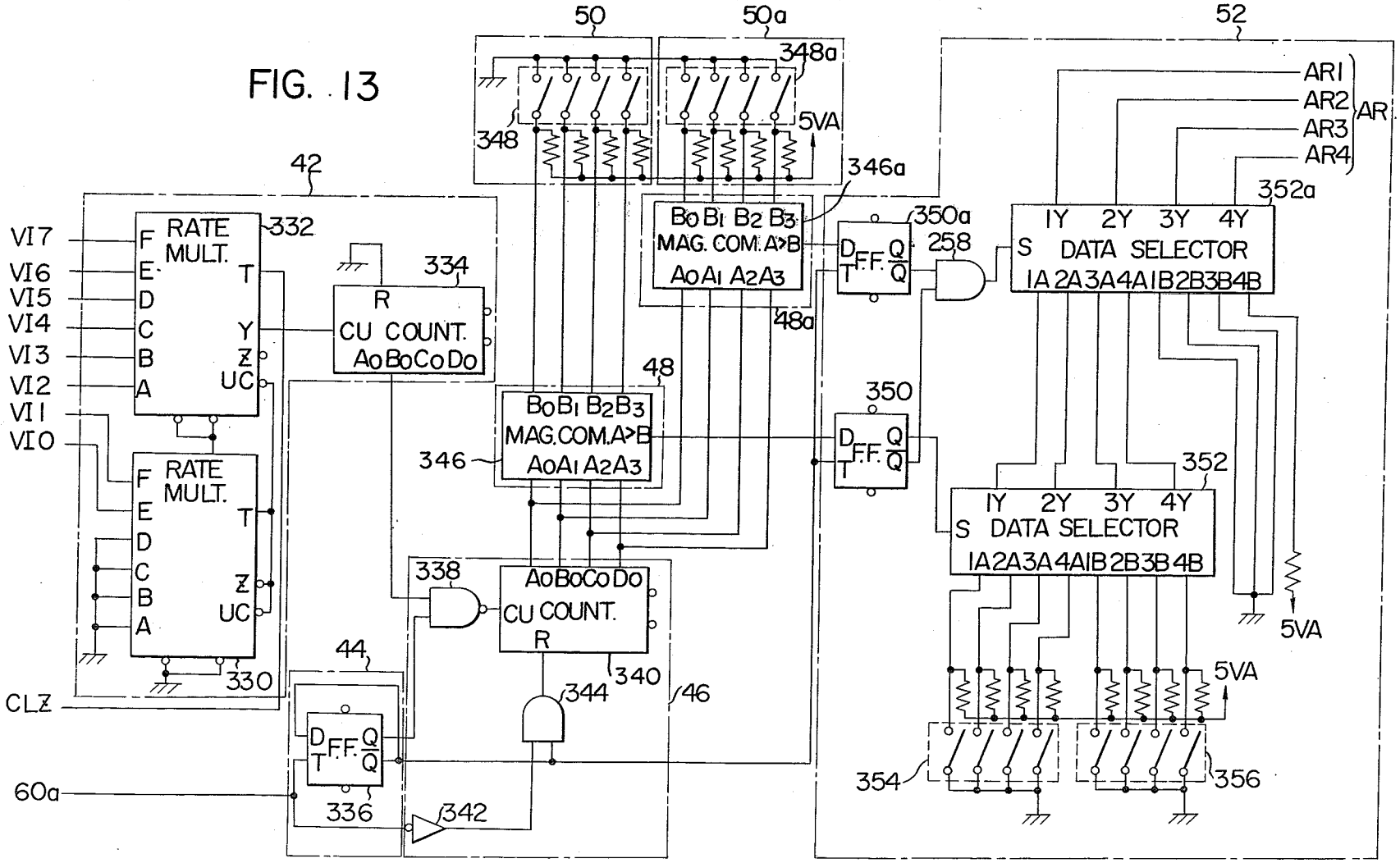
FIG. 13 is a circuit diagram of the modified speed comparator shown in FIG. 6.

In FIG. 13 wherein like reference numerals designate the components identical to or similar to those shown in FIG. 12, there is illustrated the details of the speed comparator shown in block form in FIG. 6. The arrangement illustrated is different from that shown in FIG. 12 only in that in FIG. 13 the counter 340 is further connected to another magnitude comparator 346*a* operatively associated with another switch bank 348*a* and connected to a separate D FLIP-FLOP 350*a* subsequently connected to a quadruple 2-line to 1-line data selector 352*a* through an AND gate 258. The comparator 346*a*, the switch bank 348*a*, the FLIP-FLOP 350*a* and data selector 352*a* are identical to the corresponding components 346, 348, 350 and 352 respectively.

The AND gate 258 includes one input connected to the output $\overline{Q}$ of the FLIP-FLOP 350, the other input connected to the output $\overline{Q}$ of the FLIP-FLOP 350*a* and the output connected to the selector 352*a* at the selection input S. The data selector 352*a* includes one set of four inputs 1A, 2A, 3A and 4A connected to the outputs 1Y, 2Y, 3Y and 4Y of the data selector 352 respectively and another set of four inputs 1B, 2B, 3B and 4B preliminarily set to a binary number 1000 or a decimal number 8 by having the inputs 1B, 2B and 3B connected together to ground and the input 4B connected to an electric source 5VA through a resistor.

The switch banks 348 and 348*a* form the constant registers 50 and 50*a* respectively and have set therein the constants $K_L$ and $K_S$ as described above in conjunction with FIG. 6. Thus the comparators 346 and 346*a* include the inputs $B_o$, $B_1$, $B_2$ and $B_3$ having the constants of $K_L$ and $K_S$ set thereto. Further the FLIP-FLOP's 350 and 350*a*, the AND gate 258 and the data selectors 352 and 352*a* form the speed status-determination device 52 as shown in FIG. 6.

It is recalled that the speed status-determination device can determine which of the three speed states expressed by $V_R/ > V_I/\alpha$, $V_I/\alpha \geqq V_R \geqq V_I/\beta$ and $V_I/\beta > V_R$ is fulfilled by the actual speed $V_R$.

For $V_R > V_I/\alpha$ the FLIP-FLOP 350*a* provides a binary ZERO at the output Q and the FLIP-FLOP 350 provides also a binary ZERO at the output Q. Thus both selectors 352 and 352*a* selects the A inputs or the binary number $A_L$ provided by the switch bank 354. Then the selector 352*a* delivers an acceleration rate siggal AR from its outputs 1Y, 2Y, 3Y and 4Y to the rate multiplier 216 (see FIG. 10) as in the arrangement of FIG. 12. As a result, the command speed signal is modified so as to increase the absolute magnitude of the associated acceleration.

For $V_R < V_I/\beta$, a binary ONE appears at the output Q of both FLIP-FLOP's 350 and 350a. Under these circumstances the selector 352 selects the binary number $A_s$ applied to the inputs 1B, 2B, 3B and 4B while the selector 352a selects a binary number put at the inputs 1A, 2A, 3A and 4A. As a result, the selector 352a delivers to the rate multiplier 216 (see FIG. 10) an acceleration rate signal AR corresponding to $A_s$. Therefore the command speed is modified so as to decrease the absolute magnitude of the associated acceleration.

For $V_I/\alpha \geqq V_R \geqq V_I/\beta$, the FLIP-FLOP 350a produces a binary ONE at the output Q while the FLIP-FLOP 350 produces a binary ZERO at the output Q and a binary ONE at the output $\overline{Q}$. Thus the AND gate 358 delivers a binary ONE to the selection input S of the selector 352a to cause the selector 352a to select the binary number 1000 or the decimal number 8 supplied by B inputs. As a result, the selector 352a delivers that binary number to the rate multiplier 216 as the acceleration rate signal AR. Referring back to FIG. 10, the $C_o$ output from the counter 218 becomes equal in pulse repetition frequency to the $D_o$ output from the counter 202. Therefore the command speed is not modified.

When command speeds for an elevator car are stored at equal increments of the distance of movement of the car along a command speed pattern, the stored speeds generally have unequal increments. Therefore the higher the speed the more fine the storage of the speeds will be. Also the less the speed the more rough the storage will be. However it is desirable to arrange stored speeds for use with the speed control with equal increments within the entire control region.

The distance-of-movement memory disclosed herein functions to store distances of movement with the associated command speeds and to be accessible to the command speeds with the corresponding residual distance to the stop floor during the deceleration. This means that the command speeds are stored with substantially equal increments or at equal intervals concerning the speed. Accordingly the present invention is advantageous in that the acceleration is modified at substantially equal time intervals regardless of the actual car speed in the operational state 8 where the acceleration is maximum and that the modification of acceleration is accomplished with a small capacity of the particular memory as compared with the use of the command speeds stored at equal intervals concerning the distance.

While the present invention has been illustrated and described in conjunction with a few preferred embodiments thereof it is to be understood that numerous changes and modifications may be resorted to without departing from the spirit and scope of the present invention.

What we claim is:

1. An elevator speed control system comprising, in combination, an elevator car, an elevator driving system for moving said elevator car, a pulse generator means for generating positional pulses in response to the distance of movement of said elevator car, an actual position register means for accumulating said positional pulses therein and providing a signal indicating the actual position of said elevator car, a command acceleration pattern generator means for generating a command acceleration pattern having a predetermined shape and for generating a command maximum acceleration, a command speed pattern generator means for integrating said command acceleration pattern to deliver a command speed to said elevator driving system during the acceleration of said elevator car, a stop position determination means for sensing the floor at which it is desired to stop said elevator car for producing a signal indicating the position of the desired stop floor, a subtracter means for calculating the distance to the desired stop floor by calculating the difference between the signal from said actual position register means and the signal from said stop position determination means during the decleration of said elevator car, an ideal deceleration pattern generator means responsive to the distance to the desired stop floor calculated by said substractor means during the decleration of said elevator car to provide an ideal command speed for said elevator car, a speed sensor means for sensing the actual speed of said elevator car, a speed comparator means for comparing said ideal command speed from said ideal decleration pattern generator means with the actual speed sensed by said speed sensor means, and a rate-of-acceleration modifier means responsive to the output from said speed comparator means and connected to said command acceleration pattern generator means for modifying said command acceleration pattern, whereby the actual speed of the elevator car is caused to follow the ideal command speed from said ideal decleration pattern generator means.

2. An elevator speed control system comprising, in combination, an elevator car, a pulse generator means for generating a positional pulse in response to a distance of movement of the elevator car, actual position register means for accumulating said positional pulse therein to indicate the actual position of the elevator car, first modulator means for generating a command acceleration pattern, first counter means for delivering a command speed pattern to an elevator driving system involved during the acceleration of the car through the utilization of said command acceleration pattern, distance-of-movement memory means for storing distances of movement of the car resulting from the integration of outputs from said first counter means, stop position determination means for determining a time point where the elevator car is to be stopped, thereby to deliver a stop determination signal to said first modulator means and provide a signal for a position of a desired stop floor, second counter means causing said distance-of-movement memory means to store a distance-of-movement of the car dependent upon a command speed pattern identical to that delivered from said first counter means and at a time point where said command speed pattern reaches a maximum, subtracter means for calculating a difference between the actual position of the car and said position of the desired stop floor during the deceleration of the car to provide an output representing a residual distance to the desired stop floor, a distance comparator means for comparing a stored distance read out from said distance-of-movement memory means with said residual distance provided by said subtracter means, said distance comparator means being operative to successively count pulses down at and after a time point where the stored distance is greater than the residual distance from said subtracter means as determined by said distance comparator means thereby to form an adeal speed concerning said residual distance of an output from said second counter means, a speed comparator means for comparing said output from said second counter means with the actual speed of the car to provide a signal for modifying said command acceleration pattern so as to approach the actual speed to said ideal speed in accordance with an output from said speed comparator means, and second modulator means operative during the deceleration to modify said command acceleration pattern in response to an output from said speed comparator means.

3. An elevator speed control system as claimed in claim 2 wherein said second modulator means is operatively coupled to a pair of modulation limiting means for determining an upper limit and a lower limit as to a modulation degree of said second modulator means, and wherein said second modulator means modulates said command acceleration pattern within a range of from said upper limit to said lower limit to deliver a modulated output to said first counter means.

4. An elevator speed control system as claimed in claim 2 wherein said ideal speed has a tolerance, and there is provided means responsive to the ideal speed within said tolerance to disable said speed comparator means to deliver said acceleration pattern modifying signal to said second modulator means.

5. An elevator speed control system comprising in combination, an elevator car, an elevator driving system for moving said elevator car, a pulse generator means for generating movement pulses in response to the distance of movement of said elevator car, an actual position register means for accumulating said movement pulses from said pulse generator means to provide a signal indicating the actual position of said elevator car, a command speed pattern generator means for delivering a command speed to said elevator driving system, an integrator means for integrating said command speed from said command speed pattern generator means for generating a theoretical travel distance signal from said command speed, a stop determination means for sensing the floor at which it is desired to stop said elevator car for producing a signal indicating the position of the desired stop floor, a substracter means for calculating the difference between the actual position of said elevator car from said actual position register means and the position of the desired stop floor from said stop determination means, and a speed-to-distance function memory means for continuously storing said command speeds from said command speed pattern generator means and said theoretical travel distance signals from said integrator means in the form of a speed-to-distance function during the acceleration of said elevator car and for recalling from said speed-to-distance function the command speed corresponding to said difference calculated by said subtracter means for producing an ideal deceleration speed dependent upon the residual distance to the position of the desired stop floor during the deceleration of said elevator car.

6. An elevator speed control system as claimed in claim 5 wherein said speed-to-distance function memory means comprises a reversible counter having a count down input connected to said command speed pattern generator means for counting up to said command speed during the acceleration of said elevator car and for generating said ideal deceleration speed during the deceleration of said elevator car, a random access memory receiving said theoretical travel distance from said integrator means for repetitively storing said theoretical travel distances at addresses corresponding to the output of said reversible counter during the acceleration of said elevator car and for recalling said distances from addresses corresponding to the output of said reversible counter during the decleration of said elevator car and a distance comparator for comparing the output of said random access memory with said difference calculated by said subtracter means for applying a signal to said count down input of said reversible counter for decreasing the count of said reversible counter when said difference calculated by said subtractor means is less than the output of said random access memory.

7. An elevator speed control system as claimed in claim 5 wherein said command speed pattern generator means includes a command acceleration pattern generator means for generating a command acceleration pattern having a predetermined shape and for generating a command maximum acceleration, and an acceleration integrator for integrating the output from said command acceleration pattern generator means for generating said command speed.

8. An elevator speed control system as claimed in claim 7 further comprising an actual speed sensor for sensing the actual speed of said elevator car, a speed comparator for comparing the actual speed from said actual speed sensor and the output from said speed-to-distance function memory means during the decleration of said elevator car, a rate-of-acceleration modifier responsive to the output from said speed comparator during the deceleration of said elevator car and connected to said command acceleration pattern generating means for modifying said command acceleration pattern, whereby the actual speed of said elevator car is caused to follow the output from said speed-to-distance function memory means.

9. An elevator speed control system as claimed in claim 8 wherein said rate-of-acceleration modifier has upper and lower limits of rate modification, whereby the output from said command acceleration pattern generator is changed within said limits.

10. An elevator speed control system as claimed in claim 8 wherein said rate-of-acceleration modifier includes means for preventing modification of said command acceleration pattern when the difference between said actual speed from said actual speed sensor and the output from said speed-to-distance function memory means is within a predetermined range.

* * * * *